US011635203B2

(12) United States Patent
Ogawa et al.

(10) Patent No.: US 11,635,203 B2
(45) Date of Patent: Apr. 25, 2023

(54) PREMIXING DEVICE AND COMBUSTION APPARATUS INCLUDING THE SAME

(71) Applicant: NORITZ CORPORATION, Hyogo (JP)

(72) Inventors: Kyohei Ogawa, Hyogo (JP); Keiichi Miura, Hyogo (JP); Tsuneo Funabiki, Hyogo (JP); Tatsuya Karaki, Hyogo (JP)

(73) Assignee: NORITZ CORPORATION, Hyogo (JP)

( * ) Notice: Subject to any disclaimer, the term of this patent is extended or adjusted under 35 U.S.C. 154(b) by 42 days.

(21) Appl. No.: 17/375,003

(22) Filed: Jul. 14, 2021

(65) Prior Publication Data

US 2022/0034503 A1 Feb. 3, 2022

(30) Foreign Application Priority Data

Jul. 29, 2020 (JP) ..... JP2020-128184
Jul. 29, 2020 (JP) ..... JP2020-128187

(51) Int. Cl.
*F23D 14/02* (2006.01)
*F24H 1/00* (2022.01)

(52) U.S. Cl.
CPC ..... *F23D 14/02* (2013.01); *F24H 1/0027* (2013.01)

(58) Field of Classification Search
USPC ..... 431/354
See application file for complete search history.

(56) References Cited

U.S. PATENT DOCUMENTS 2,790,680 A * 4/1957 Rosholt ..... B05B 1/1654 239/487
6,079,434 A * 6/2000 Reid ..... G05D 16/0655 137/484.8
7,900,522 B2 * 3/2011 Reeve ..... G01F 1/40 73/861.77
7,967,006 B2 * 6/2011 Deng ..... F23C 1/08 431/278
2006/0006240 A1 * 1/2006 Singleton ..... G09F 3/04 235/487
2021/0140632 A1 * 5/2021 Park ..... F23D 14/64

FOREIGN PATENT DOCUMENTS

JP H11502278 2/1999

* cited by examiner

*Primary Examiner* — Steven B McAllister
*Assistant Examiner* — John E Bargero
(74) *Attorney, Agent, or Firm* — JCIPRNET

(57) ABSTRACT

A premixing flow path forming member of a premixing device includes a member whose attachment mode can be changed, and flow path resistance of a fuel gas flow path can be changed when the attachment mode of the member is changed.

10 Claims, 34 Drawing Sheets

PREMIXING DEVICE AND COMBUSTION APPARATUS INCLUDING THE SAME

CROSS-REFERENCE TO RELATED APPLICATION

This application claims the priority benefit of Japan application serial no. 2020-128184, filed on Jul. 29, 2020 and no. 2020-128187, filed on Jul. 29, 2020. The entirety of each of the above-mentioned patent applications is hereby incorporated by reference herein and made a part of this specification.

BACKGROUND

Technical Field

The disclosure relates to a premixing device and a combustion apparatus including the same.

Here, the term "premixing" refers to processing of premixing air and fuel gas to generate combustible mixed gas for the purpose of performing premixing combustion.

Description of Related Art

As a specific example of a premixing device, there is one described in Patent Document 1.

The premixing device described in the document includes a tubular member (premixing flow path forming member) that forms a venturi-shaped premixing flow path, and two vertical and horizontal blade parts attached in the tubular member. An air intake side of a fan is connected to a downstream side (terminal side) of the premixing flow path, and air flows into the premixing flow path from an upstream side (starting end side) thereof. A fuel gas outlet is provided in the blade parts, and when air flows through the premixing flow path and a negative pressure is generated, fuel gas flows out from the fuel gas outlet to the premixing flow path and is mixed with air due to an action of the negative pressure.

However, in the above-described conventional technology, there was room for improvement as described below.

That is, as fuel gas used in the premixing device, it may be either one of two types of fuel gas, for example, natural gas and LP gas. In this case, since components and a heat generation rate of the two types of fuel gas are different from each other, the premixing device needs to have specifications according to types of fuel gas.

Specifically, a fuel gas flow path for guiding fuel gas from the outside of a premixing flow path forming member to a fuel gas outlet is provided in a premixing device, and the fuel gas flow path needs to be made to correspond to types of fuel gas. When a generated negative pressure is uniform in the premixing flow path, fuel gas with a low heat generation rate has to be set so that an amount of outflow from the fuel gas outlet to the premixing flow path is larger than that of fuel gas with a high heat generation rate, and the premixing device needs to be set to such specifications.

In contrast, conventionally, no method for simply and appropriately handling the above-described matter has been proposed. Conventionally, parts according to types of fuel gas are manufactured and prepared in advance, and when fuel gas of a type different from planned fuel gas is used, the reality is that a countermeasure such as replacing parts, adding new parts, or the like is employed. However, this requires parts for replacement or addition and the size of an inventory also increases, thereby causing high costs. Also, management of parts becomes troublesome. Further, when a part is replaced, there is a likelihood that the replaced original part will become a disused article.

PATENT DOCUMENTS

[Patent Document 1] Published Japanese Translation No. H11-502278 of the PCT International Publication

SUMMARY

According to an embodiment of the disclosure, there is provided a premixing device including a premixing flow path forming member which causes air to flow in a predetermined direction and forms a premixing flow path for mixing fuel gas with the air, and a fuel gas flow path which includes a fuel gas supply port which receives supply of the fuel gas from the outside and a fuel gas outlet which opens to the premixing flow path and guides the fuel gas supplied to the fuel gas supply port to the fuel gas outlet, in which a member whose attachment mode is able to be changed is further provided, and flow path resistance of the fuel gas flow path is able to be changed when the attachment mode of the member is changed.

In the premixing device according to an embodiment of the disclosure, a fuel gas flow path adjusting member attached directly or indirectly to the premixing flow path forming member and configured to be able to close a part of the fuel gas flow path is provided as the member whose attachment mode is able to be changed, and a position and/or an area of the fuel gas flow path adjusting member closing the fuel gas flow path is changed and the flow path resistance of the fuel gas flow path is able to be changed when the attachment mode of the fuel gas flow path adjusting member is changed.

Here, "the attachment mode of the fuel gas flow path adjusting member is able to be changed" corresponds to a case in which at least any one of an attachment position, a direction, an angle, or a posture of the fuel gas flow path adjusting member can be changed.

The "area closing the fuel gas flow path is changed" includes a case in which the area closing the fuel gas flow path is changed to zero.

In the premixing device according to an embodiment of the disclosure, the fuel gas flows out from the fuel gas outlet to the premixing flow path due to an action of a negative pressure generated due to an airflow in the premixing flow path.

The fuel gas includes predetermined first and second fuel gases of different types, and according to an embodiment of the disclosure, in the premixing device of the disclosure, either one of a first attachment mode in which the fuel gas flow path is configured to correspond to the first fuel gas and a second attachment mode in which the fuel gas flow path is configured to correspond to the second fuel gas is able to be selectively set as the attachment mode of the fuel gas flow path adjusting member.

The premixing device according to an embodiment of the disclosure further includes first and second gas type display portions indicating the first and second fuel gases, respectively, in which the first gas type display portion is covered and hidden by the fuel gas flow path adjusting member and the second gas type display portion is in an exposed state when the fuel gas flow path adjusting member is set to the second attachment mode, while the second gas type display portion is covered and hidden by the fuel gas flow path adjusting member and the first gas type display portion is in an exposed state when the fuel gas flow path adjusting member is set to the first attachment mode.

The premixing device according to an embodiment of the disclosure further includes a pipe joint part including a cylindrical part having an open distal end for connecting a gas pipe which supplies the fuel gas, in which the fuel gas supply port is provided to an inner sidewall part in the cylindrical part, and the fuel gas flow path adjusting member is inserted into the cylindrical part from a distal end opening thereof and is attached to the inner sidewall part using a fastening member.

According to an embodiment of the disclosure, a portion of the fuel gas flow path close to the fuel gas supply port is divided into a plurality of parallel flow paths, and a plurality of fuel gas supply ports corresponding to the plurality of parallel flow paths is provided as the fuel gas supply port, and a position and/or the number in which the fuel gas flow path adjusting member closes the plurality of fuel gas supply ports is able to be changed.

In the premixing device according to an embodiment of the disclosure, first and second parallel flow paths having different flow path areas are provided as the plurality of parallel flow paths, and first and second fuel gas supply ports corresponding to the first and second parallel flow paths are provided as the plurality of fuel gas supply ports, and the fuel gas flow path adjusting member is able to selectively close one of the first and second fuel gas supply ports.

According to an embodiment of the disclosure, portions of the first and second parallel flow paths close to the first and second fuel gas supply ports have the same shape and size, and the fuel gas flow path adjusting member includes a sealing protruding part which is able to be fitted into the portion close to the first and second fuel gas supply ports.

According to an embodiment of the disclosure, the premixing device according to the disclosure further includes a pipe joint part for connecting a gas pipe which supplies the fuel gas as the member whose attachment mode is able to be changed, and a base part to which the pipe joint part is attached, in which a joint side hole and a base side hole which are configured to face each other to communicate with each other are provided in the pipe joint part and the base part as holes constituting a part of the fuel gas flow path, and the pipe joint part is configured to be able to change an attachment mode thereof with respect to the base part, and when the attachment mode is changed, a facing position and/or a facing area of the joint side hole and the base side hole is changed, and flow path resistance of the fuel gas flow path is able to be changed.

Here, "an attachment mode with respect to the base part is able to be changed" corresponds to a case in which at least any one of an attachment position, a direction, an angle, or a posture of the pipe joint part to the base part can be changed.

The fuel gas includes predetermined first and second fuel gases of different types, and according to an embodiment of the disclosure, in the premixing device of the disclosure, either one of a first attachment mode in which the facing area is an area made to correspond to the first fuel gas and a second attachment mode in which the facing area is an area made to correspond to the second fuel gas is able to be selectively set as the attachment mode of the pipe joint part.

In the premixing device according to an embodiment of the disclosure, first and second gas type display portions respectively indicating the first and second fuel gases are provided on the base part, and the first gas type display portion is covered and hidden by the pipe joint part and the second gas type display portion is in an exposed state when the pipe joint part is set to the second attachment mode, while the second gas type display portion is covered and hidden by the pipe joint part and the first gas type display portion is in an exposed state when the pipe joint part is set to the first attachment mode.

In the premixing device according to an embodiment of the disclosure, at least two base side holes having different inner diameters are provided to be aligned as the base side hole, the first attachment mode is a mode in which one of the two base side holes faces the joint side hole and the other is closed by the pipe joint part, and the second attachment mode is a mode in which a direction of the pipe joint part is reversed compared to that in the first attachment mode, and the one of the two base side holes is closed by the pipe joint part and the other faces the joint side hole.

In the premixing device according to an embodiment of the disclosure, at least two joint side holes having different inner diameters are provided to be aligned as the joint side hole, the first attachment mode is a mode in which one of the two joint side holes faces the base side hole and the other is closed by the base part, and the second attachment mode is a mode in which a direction of the pipe joint part is reversed compared to that in the first attachment mode, and the one of the two joint side holes is closed by the base part and the other faces the base side hole.

According to an embodiment of the disclosure, there is provided a combustion apparatus including the premixing device provided in the disclosure.

Other features and advantages of the disclosure will become apparent from the following description of embodiments of the disclosure with reference to the accompanying drawings.

BRIEF DESCRIPTION OF THE DRAWINGS

FIG. 9A is a perspective view from an outer surface side, and FIG. 9B is a perspective view from an inner surface side.

FIG. 25A is a front view of a main part, and FIG. 25B is a cross-sectional view along line XXV-XXV of FIG. 25A.

FIG. 26A is a front view of a main part, and FIG. 26B is a cross-sectional view along line XXVI-XXVI of FIG. 26A.

FIG. 28A is a front view of a main part, and FIG. 28B is a cross-sectional view along line XXVIII-XXVIII of FIG. 28A.

DESCRIPTION OF THE EMBODIMENTS

According to an embodiment of the disclosure is to provide a premixing device capable of appropriately handling a plurality of types of fuel gas without replacing a part or adding a new part according to types of fuel gas, and a combustion apparatus including the same.

Hereinafter, embodiments of the disclosure will be specifically described with reference to the drawings.

Figure 1:
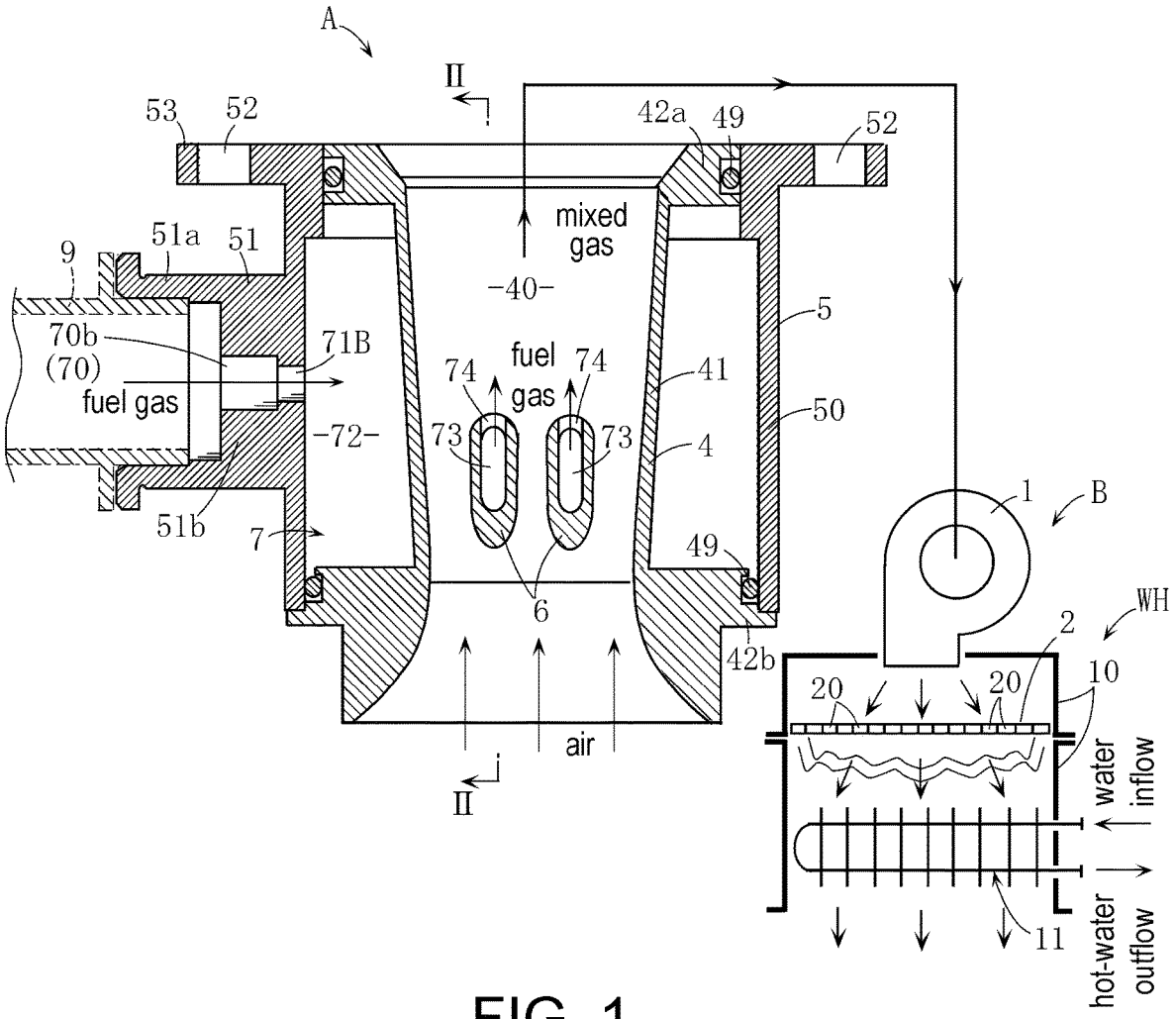
FIG. 1 is an explanatory view illustrating an example of a combustion apparatus including a premixing device according to the disclosure and a hot-water supply device utilizing the combustion apparatus.

FIG. 1 illustrates a premixing device A, a combustion apparatus B (premix combustion apparatus) configured by combining a fan 1 and a combustion plate 2 with the premixing device A, and a hot-water supply device WH configured by combining a heat exchanger 11 with the combustion apparatus B.

Although details of the premixing device A will be described later, mixed gas (combustible mixed gas) of air and a fuel gas is generated using the premixing device A, and the mixed gas is discharged toward the combustion plate 2 via the fan 1. The combustion plate 2 is a porous plate having a plurality of vent holes 20 and is housed in a case 10, and the mixed gas passes through the combustion plate 2 and burns below the combustion plate 2. Combustion gas generated in this way acts on the heat exchanger 11, and water passing through the inside of the heat exchanger 11 is heated. In this way, hot water is generated, and the hot water is supplied to a desired hot water supply destination.

The premixing device A includes a premixing flow path forming member 4 having a tubular part 41 that forms a premixing flow path 40, a housing member 5 attached to the premixing flow path forming member 4, each blade part 6 in which a fuel gas outlet 74 is provided, a fuel gas flow path 7 including the fuel gas outlet 74, and a fuel gas flow path adjusting member 8 illustrated in FIGS. 3 to 9B.

The premixing flow path forming member 4 is connected to an air intake side of the fan 1, and when the fan 1 is driven, external air flows into the premixing flow path 40 from an opening on one end side thereof. The premixing flow path 40 has a venturi shape in which a region on an upstream side in a gas flow direction is a tapered region in which an inner diameter thereof gradually decreases toward a downstream side in the gas flow direction, and a region on the downstream side of the tapered region is a tapered region in which an inner diameter thereof gradually increases toward the downstream side.

Figure 2:
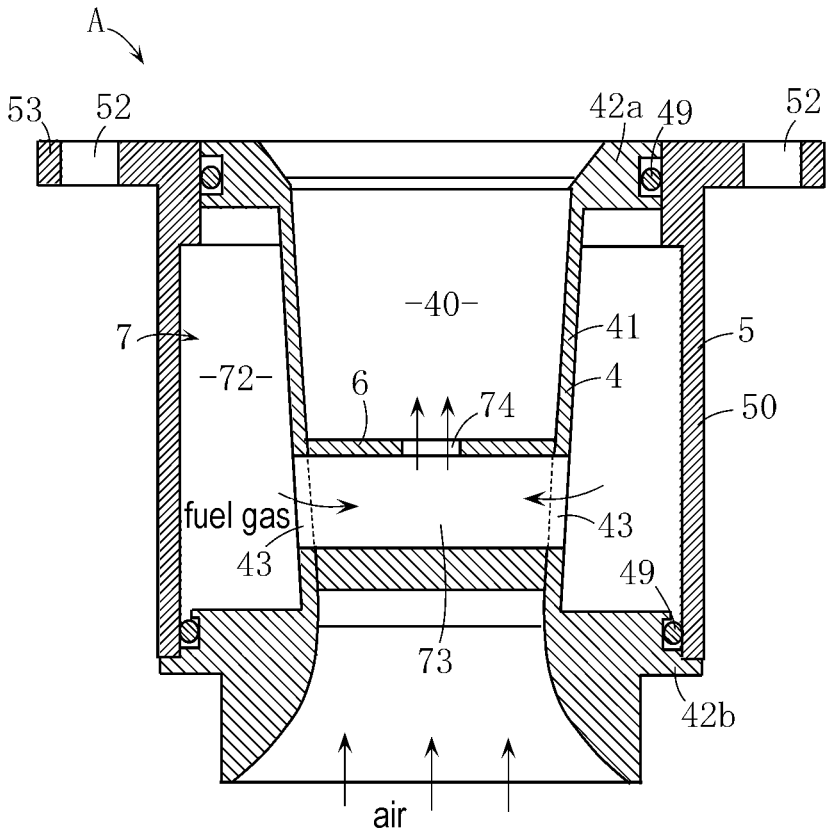
FIG. 2 is a cross-sectional view along line of FIG. 1.
Figure 3:
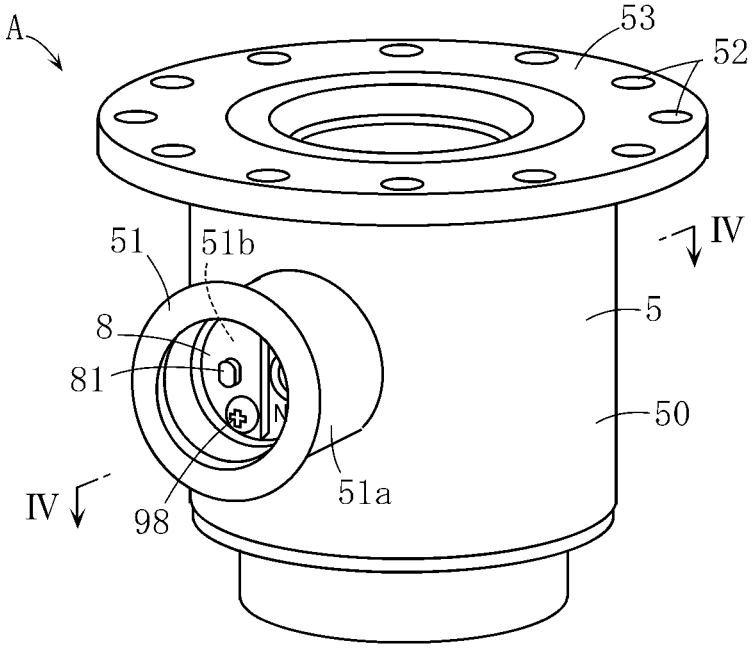
FIG. 3 is an external perspective view of the premixing device illustrated in FIGS. 1 and 2.

Each blade part 6 is a portion that serves the role of a nozzle for allowing fuel gas to flow out from the fuel gas outlet 74 to the premixing flow path 40, has a bridging shape in which both end portions are connected to a circumferential wall part of the tubular part 41, and is positioned in the premixing flow path 40 as illustrated in FIG. 2. A pair of blade parts 6 are aligned substantially in parallel with each other at an appropriate distance in a thickness direction (left-right direction in FIG. 1) of them.

The inside of each blade part 6 is a hollow part 73 that forms a part of the fuel gas flow path 7, and the fuel gas outlet 74 communicates with the hollow part 73. On the other hand, an airflow in the premixing flow path 40 generates a negative pressure in the vicinity of the fuel gas outlet 74. Due to an action of the negative pressure, fuel gas flows out from the fuel gas outlet 74 to the premixing flow path 40, and air and fuel gas are mixed.

The number of blade parts 6 is not limited to two and may be only one or three or more.

The housing member 5 includes a cylindrical housing main body part 50, a pipe joint part 51 that is integrally or separately provided to the housing main body part 50, and a flange part 53 having a bolt insertion hole 52. The flange part 53 helps the premixing device A easily and appropriately connect to a desired portion.

The housing main body part 50 is fitted onto step parts 42*a* and 42*b* provided on an outer circumference of the premixing flow path forming member 4 and surrounds the premixing flow path forming member 4 in a hermetically sealed state due to a sealing ring 49. A region 72 between the premixing flow path forming member 4 and the housing main body part 50 forms a part of the fuel gas flow path 7.

The pipe joint part 51 is a portion to which a gas pipe 9 (also including a hose) for supplying fuel gas is connected, and fuel gas supplied from the gas pipe 9 to the pipe joint part 51 flows into the above-described region 72. As illustrated in FIG. 2, an opening 43 communicating with the hollow part 73 in each blade part 6 is formed in the premixing flow path forming member 4. Fuel gas that has flowed into the region 72 passes through the opening 43, flows into each blade part 6, and flows out from the fuel gas outlet 74 as described above.

When the pipe joint part 51 is described in more detail, the pipe joint part 51 includes a cylindrical part 51*a* having an open distal end, and an inner sidewall part 51*b* to which a fuel gas supply port 70 is provided is provided at an innermost portion in the cylindrical part 51*a*.

The fuel gas flow path 7 is a flow path that guides fuel gas from the fuel gas supply port 70 to the fuel gas outlet 74. However, as illustrated in FIGS. 4A to 8, in the pipe joint part 51, first and second parallel flow paths 71A and 71B that form a part of the fuel gas flow path 7 are provided to be aligned at an appropriate distance, and first and second fuel gas supply ports 70*a* and 70*b* are provided as openings thereof.

Figure 4A:
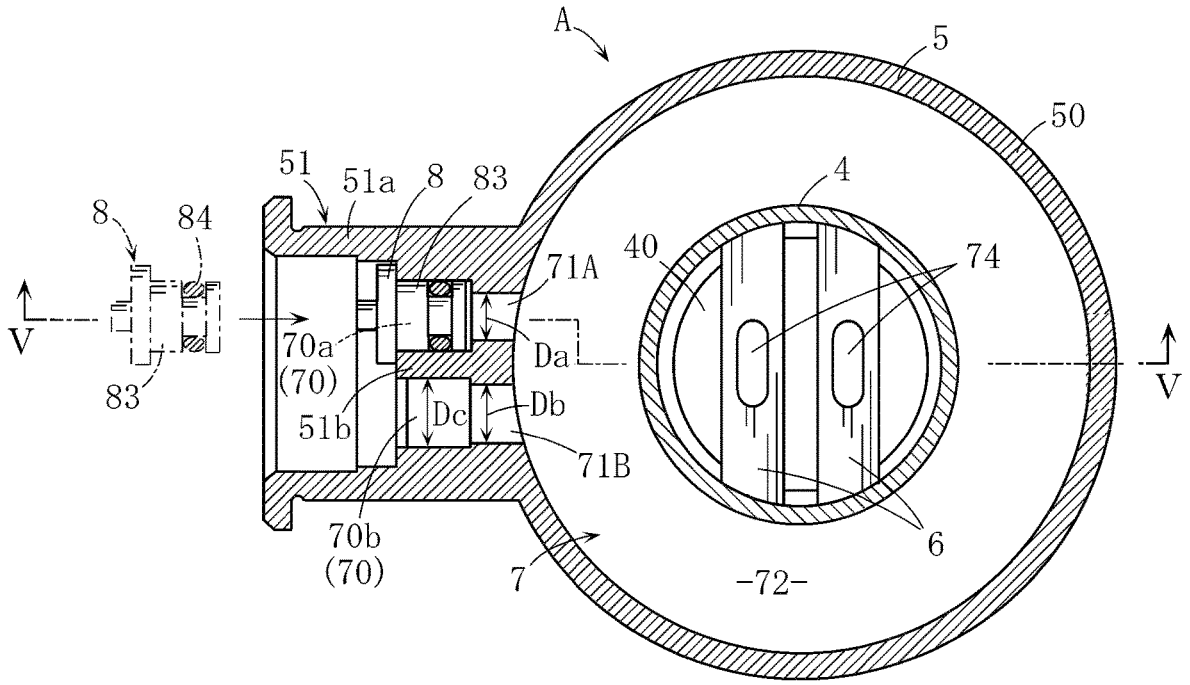
FIG. 4A is a cross-sectional view along line IV-IV of FIG. 3.
Figure 4B:
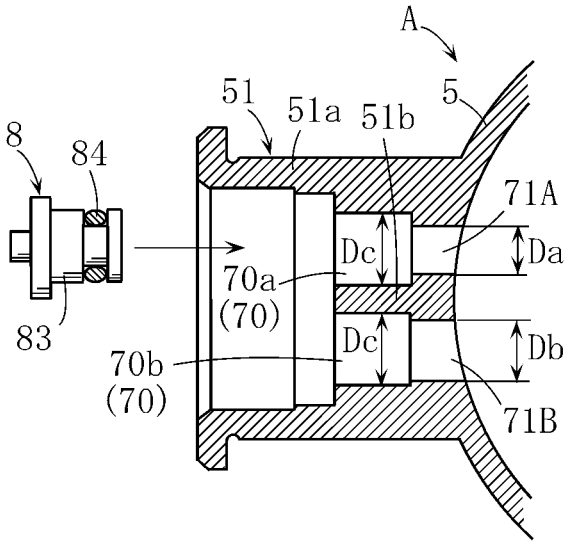
FIG. 4B is an exploded cross-sectional view of FIG. 4A.

As illustrated in FIGS. 4A and 4B, the first and second parallel flow paths 71A and 71B have different inner diameters Da and Db and have a relationship of Da<Db. The inner diameter Da is a flow path inner diameter that is suitable when LP gas is used as fuel gas. The inner diameter Db is a flow path inner diameter that is suitable when natural gas is used as fuel gas.

However, inner diameters Dc of portions (portions close to the first and second fuel gas supply ports 70*a* and 70*b*) into which a sealing protruding part 83 of the fuel gas flow path adjusting member 8, which will be described later, is fitted have inner diameters larger than the above-described inner diameters Da and Db and have the same dimension.

Figure 7:
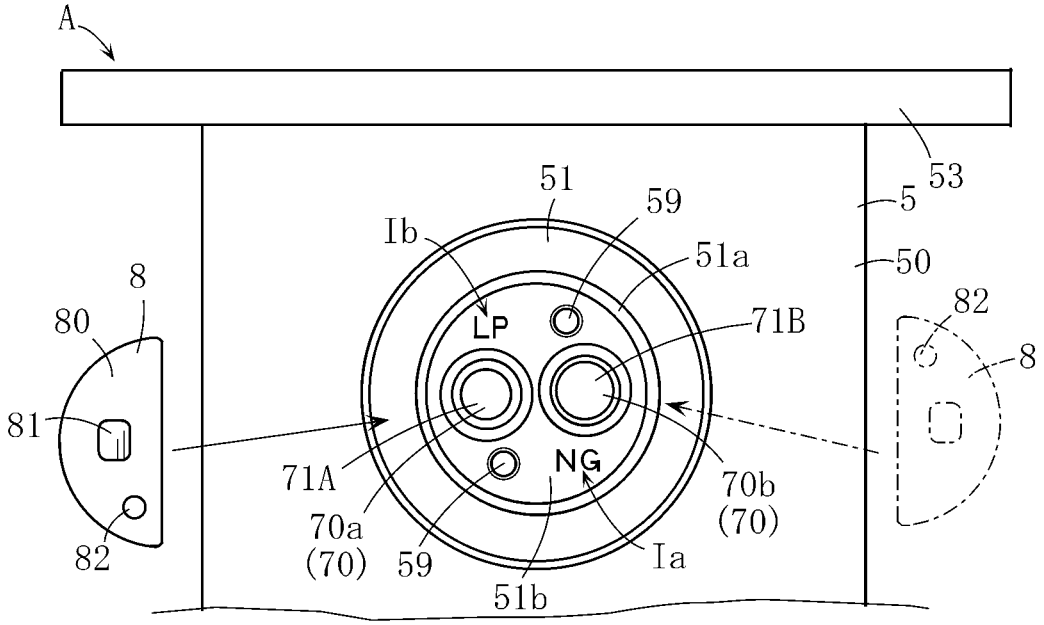
FIG. 7 is an exploded front view of the main part of FIG. 6.

As is clearly illustrated in FIG. 7, first and second gas type display portions 1*a* and 1*b* and two screw holes 59 are also provided on the inner sidewall part 51*b* of the pipe joint part 51. The first and second gas type display portions 1*a* and 1*b* are respectively provided at positions near an upper side or a lower side of the first and second fuel gas supply ports 70*a* and 70*b* and are display portions indicating that the first and second fuel gas supply ports 70*a* and 70*b* correspond to LP gas and natural gas, respectively. These are, for example, characters of "LP" and "NG." However, a display mode different from this may also be used.

Figure 5:
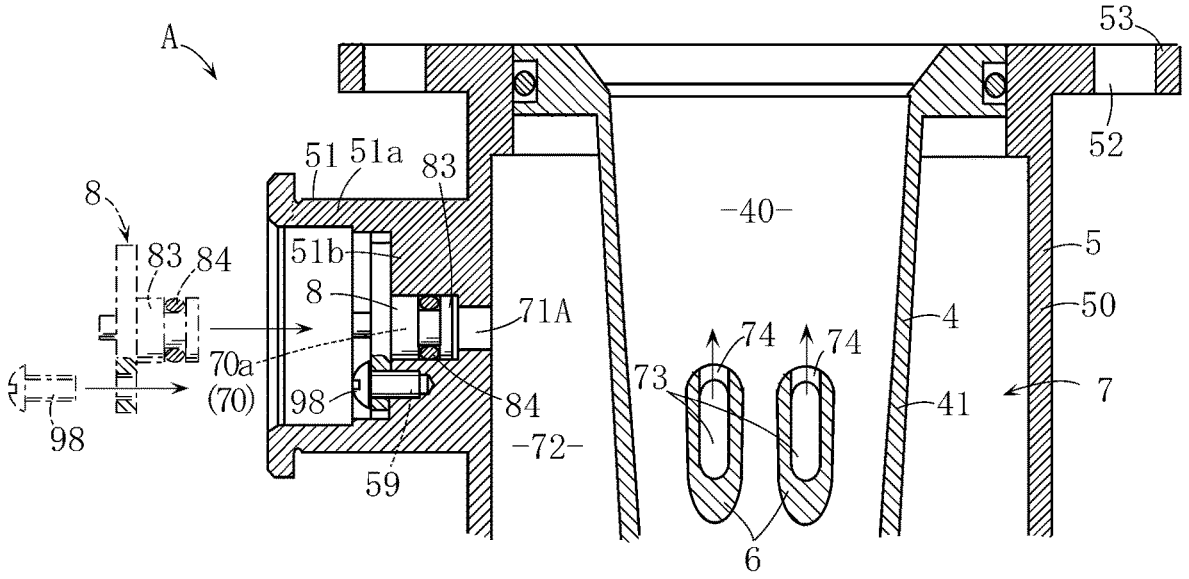
FIG. 5 is a cross-sectional view along line V-V of FIG. 4A.
Figure 6:
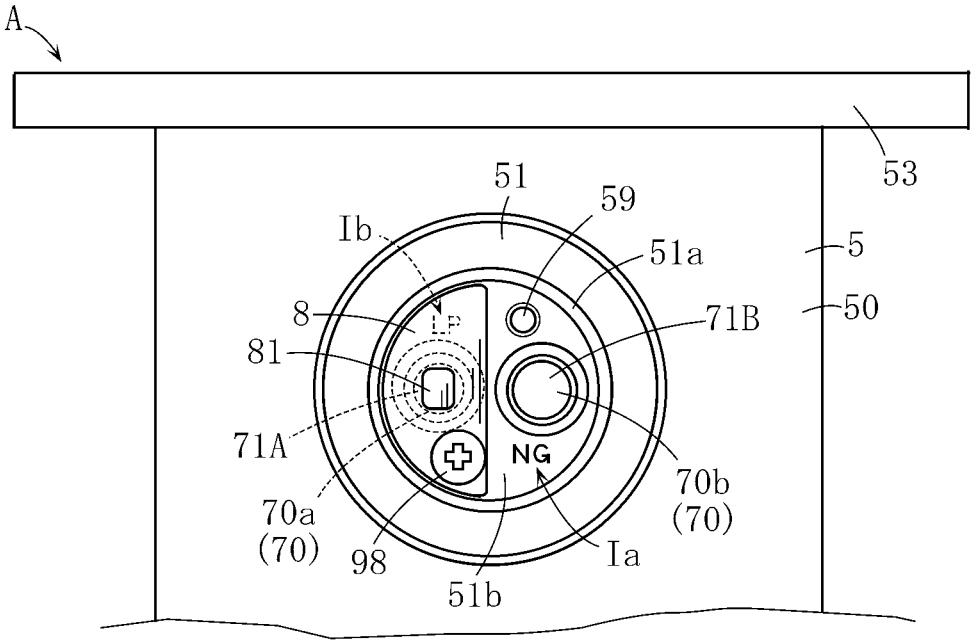
FIG. 6 is a front view of a main part of a premixing device illustrated in FIG. 3.
Figure 9A:
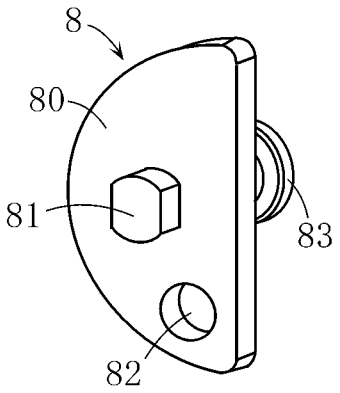
FIGS. 9A and 9B illustrate the fuel gas flow path adjusting member used in the premixing devices illustrated in FIGS. 1 to 8.
Figure 9B:
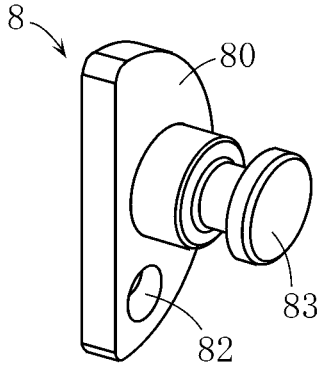

The fuel gas flow path adjusting member 8 is a member for selectively closing either one of the first and second fuel gas supply ports 70*a* and 70*b* according to types of fuel gas. For example, as illustrated in FIGS. 9A and 9B, the fuel gas flow path adjusting member 8 includes a semicircular plate-shaped main body part 80, and has a configuration in which a knob part 81, a screw body insertion hole 82, and the sealing protruding part 83 are provided in the main body part 80. As illustrated in FIGS. 4A, 4B, and 5, a sealing O-ring 84 is externally fitted and mounted on the sealing protruding part 83.

As illustrated in FIGS. 4A to 6, the fuel gas flow path adjusting member 8 is attached to the inner sidewall part 51*b* of the pipe joint part 51, for example, in a mode of closing the first fuel gas supply port 70*a* (first attachment mode). This attachment is performed utilizing a screw body 98 (fastening member) such as a screw screwed into the screw hole 59. In this first attachment mode, the sealing protruding part 83 is fitted into the first fuel gas supply port 70*a*, and the second gas type display portion 1*b* is covered and hidden by the fuel gas flow path adjusting member 8. The first gas type display portion 1*a* is not covered and hidden by the fuel gas flow path adjusting member 8 and is in a state in which it is exposed on a front surface of the pipe joint part 51.

Figure 8:
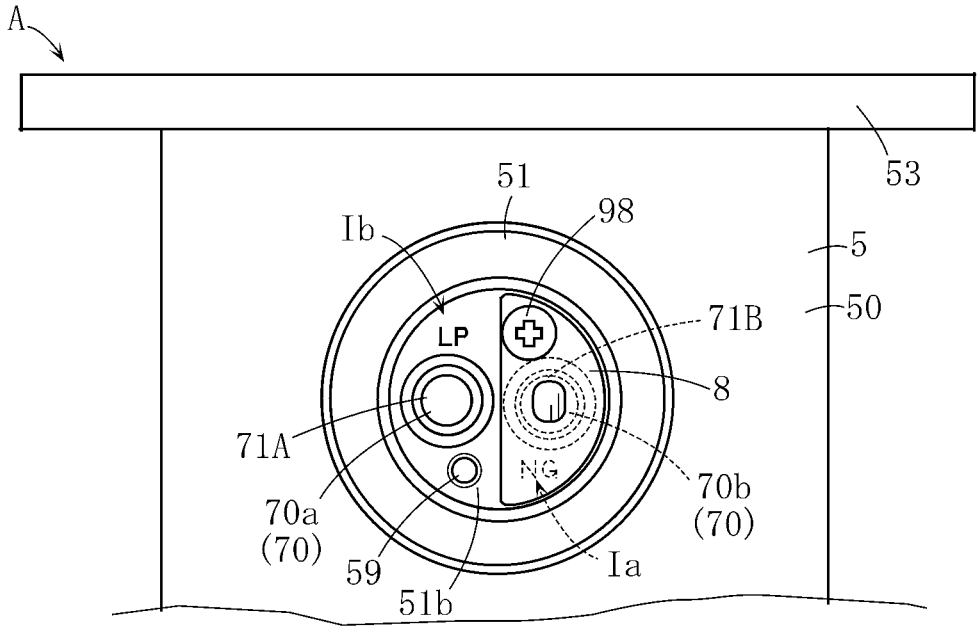
FIG. 8 is a front view of a main part illustrating an example in which a fuel gas flow path adjusting member is set to a mode different from that of FIG. 6.

The fuel gas flow path adjusting member 8 can also be set to a mode in which the second fuel gas supply port 70*b* is closed (second attachment mode) as illustrated in FIG. 8 as an attachment mode with respect to the inner sidewall part 51*b* of the pipe joint part 51. A change from the first attachment mode to the second attachment mode can be performed by loosening the fastening state due to the screw body 98, temporarily removing the fuel gas flow path adjusting member 8 from the inner sidewall part 51*b*, and then reattaching the fuel gas flow path adjusting member 8 in a vertically inverted posture to the inner sidewall part 51*b* utilizing the screw body 98. In the second attachment mode, contrary to the first attachment mode, the sealing protruding part 83 is fitted into the second fuel gas supply port 70*b*, the first gas type display portion 1*a* is covered and hidden by the fuel gas flow path adjusting member 8, and the second gas type display portion 1*b* is in a state in which it is exposed on the front surface of the pipe joint part 51.

Next, the operation of the above-described premixing device A will be described.

First, when fuel gas is, for example, natural gas as an environment in which the premixing device A is used, the fuel gas flow path adjusting member 8 is set to the first attachment mode as illustrated in FIGS. 3 to 6. Thereby, the first parallel flow path 71A is in a state in which it is closed by the fuel gas flow path adjusting member 8, and the second parallel flow path 71B is an effective flow path that forms a part of the fuel gas flow path 7. The inner diameter Db of the second parallel flow path 71B corresponds to natural gas as described above. Since a heat generation rate of natural gas is lower than that of LP gas, an amount of gas with respect to air needs to be increased compared to a case in which LP gas is used, but it is possible to appropriately respond to such a need according to the first attachment mode. That is, since the second parallel flow path 71B has a larger inner diameter than the first parallel flow path 71A and flow path resistance of the fuel gas flow path 7 can be reduced, a large amount of natural gas can be made to flow out from the fuel gas outlet 74 due to an action of the negative pressure generated due to the airflow in the premixing flow path 40.

Unlike the above, when fuel gas is LP gas, the fuel gas flow path adjusting member 8 need only be changed to the second attachment mode as illustrated in FIG. 8. The change from the first attachment mode to the second attachment mode can be easily and quickly performed by loosening the screw body 98 or the like as described above. In the second attachment mode, contrary to the first attachment mode, the second parallel flow path 71B is closed, and the first parallel flow path 71A is an effective flow path that forms a part of the fuel gas flow path 7. The inner diameter Da of the first parallel flow path 71A corresponds to LP gas as described above. Since a heat generation rate of LP gas is higher than that of natural gas, an amount of gas with respect to air needs to be decreased, but it is possible to appropriately respond to such a need according to the second attachment mode.

As described above, according to the present embodiment, there is no need to replace parts or add and attach new parts regardless of whether fuel gas is LP gas or natural gas, and it is possible to appropriately respond to types of fuel gas simply by changing the attachment mode of the fuel gas flow path adjusting member 8. Therefore, there is no problem such as an increase in the number of parts in stock to respond to types of fuel gas, and costs incurred for inventory of parts can be reduced. Also, management of parts also becomes easier.

Also, according to the present embodiment, when the fuel gas flow path adjusting member 8 is set to the first attachment mode, the second gas type display portion 1*b* is covered and hidden, but the characters "NG" which are the first gas type display portion 1*a* remain exposed. Conversely, when the fuel gas flow path adjusting member 8 is set to the second attachment mode, the first gas type display portion 1*a* is covered and hidden while the characters "LP" which are the second gas type display portion 1*b* are exposed. Therefore, when such a display is ascertained, it is possible to easily and accurately determine whether or not the attachment mode of the fuel gas flow path adjusting member 8 is in an appropriate attachment mode that corresponds to actual types of fuel gas.

In addition, since the fuel gas flow path adjusting member 8 is formed in a small piece shape as a whole and is attached inside the pipe joint part 51, the fuel gas flow path adjusting member 8 does not become significantly bulky and increase in size of the premixing device A can be suppressed.

FIGS. 10 to 40 illustrate other embodiments of the disclosure. In these figures, elements that are the same as or similar to those of the above-described embodiment will be denoted by the same reference signs as those in the above-described embodiment, and duplicate description will be omitted.

In a premixing device Aa illustrated in FIGS. 10 to 14, a plurality of (for example, four) parallel flow paths 71 is provided in an inner sidewall part 51*b* of a pipe joint part 51, and a plurality of fuel gas supply ports 70 as openings thereof is concentrically aligned. A screw hole 59 is provided at a central portion of the inner sidewall part 51*b*, and a plurality of recessed parts 58 for positioning is provided around the screw hole 59.

Figure 15:
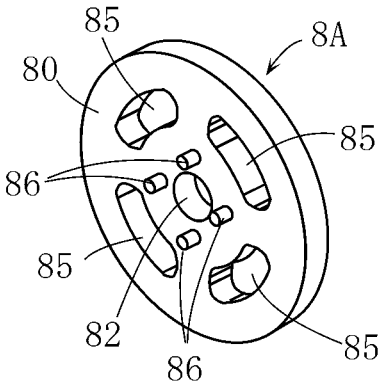
FIG. 15 is a perspective view from an inner surface side illustrating the fuel gas flow path adjusting member used in the premixing device illustrated in FIGS. 10 to 14.

As is clearly illustrated in FIG. 15, a fuel gas flow path adjusting member 8A has a configuration in which the same number of long hole-shaped openings 85 as the number of the fuel gas supply ports 70 are provided to penetrate a disc-shaped main body part 80, and a plurality of protruding parts 86 for positioning is provided to protrude on an inner surface side of the main body part 80. The plurality of protruding parts 86 for positioning is a portion that is fitted into the plurality of recessed parts 58 to serve the role of positioning the fuel gas flow path adjusting member 8A when the fuel gas flow path adjusting member 8A is set to first and second attachment modes to be described later.

Figure 10:
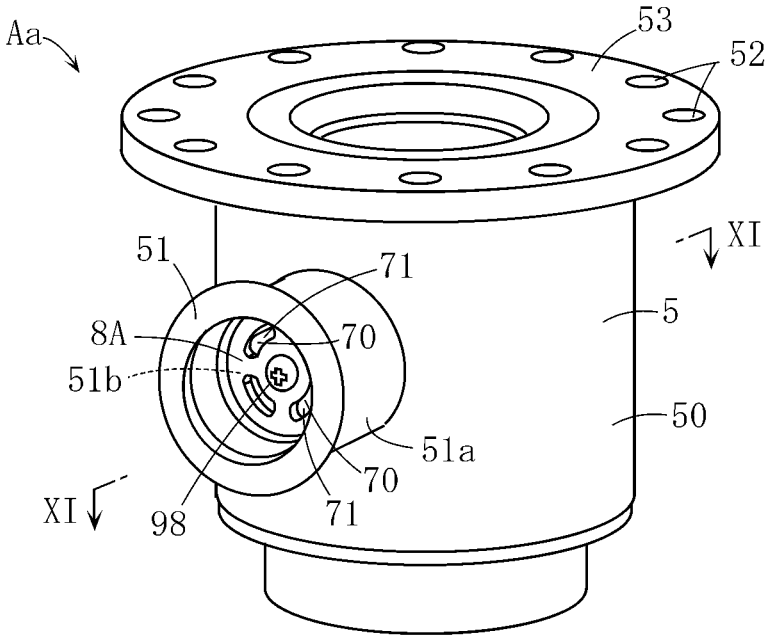
FIG. 10 is an external perspective view illustrating another example of the premixing device according to the disclosure.
Figure 11A:
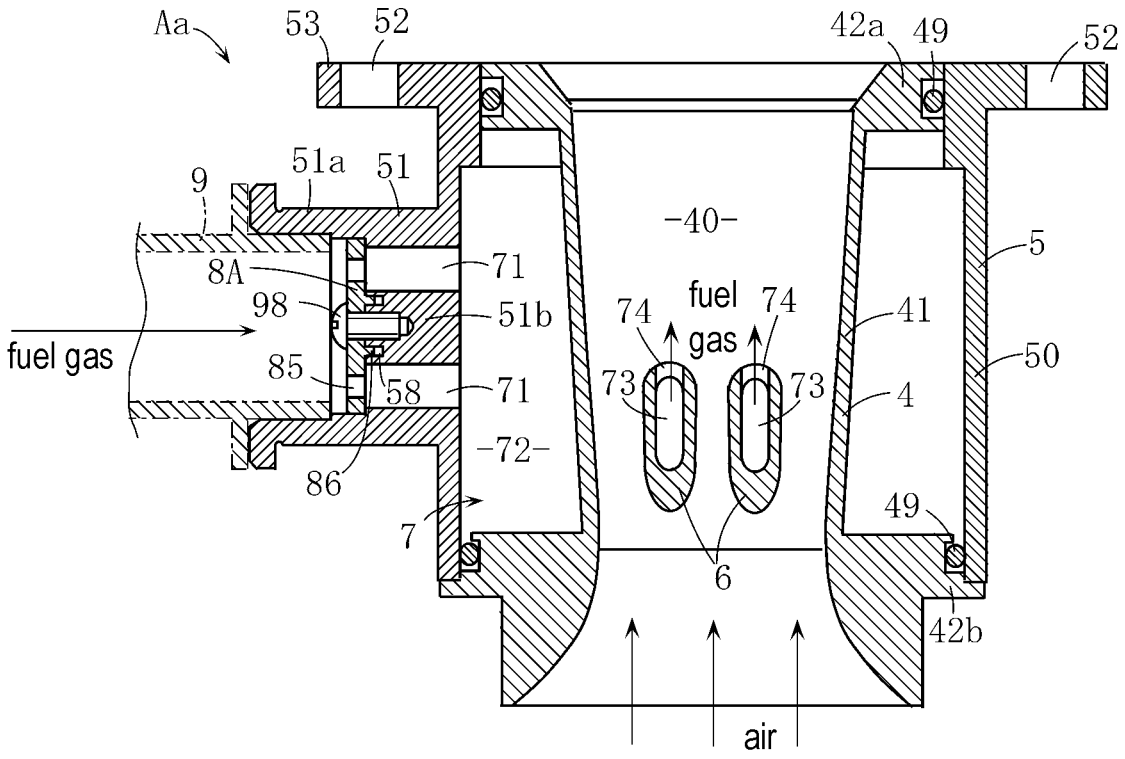
FIG. 11A is a cross-sectional view along line XI-XI of FIG. 10.
Figure 11B:
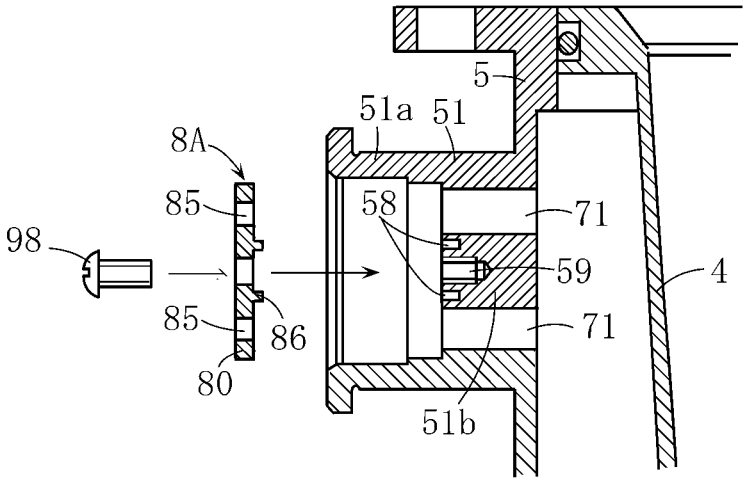
FIG. 11B is an exploded cross-sectional view of a main part of FIG. 11A.
Figure 12:
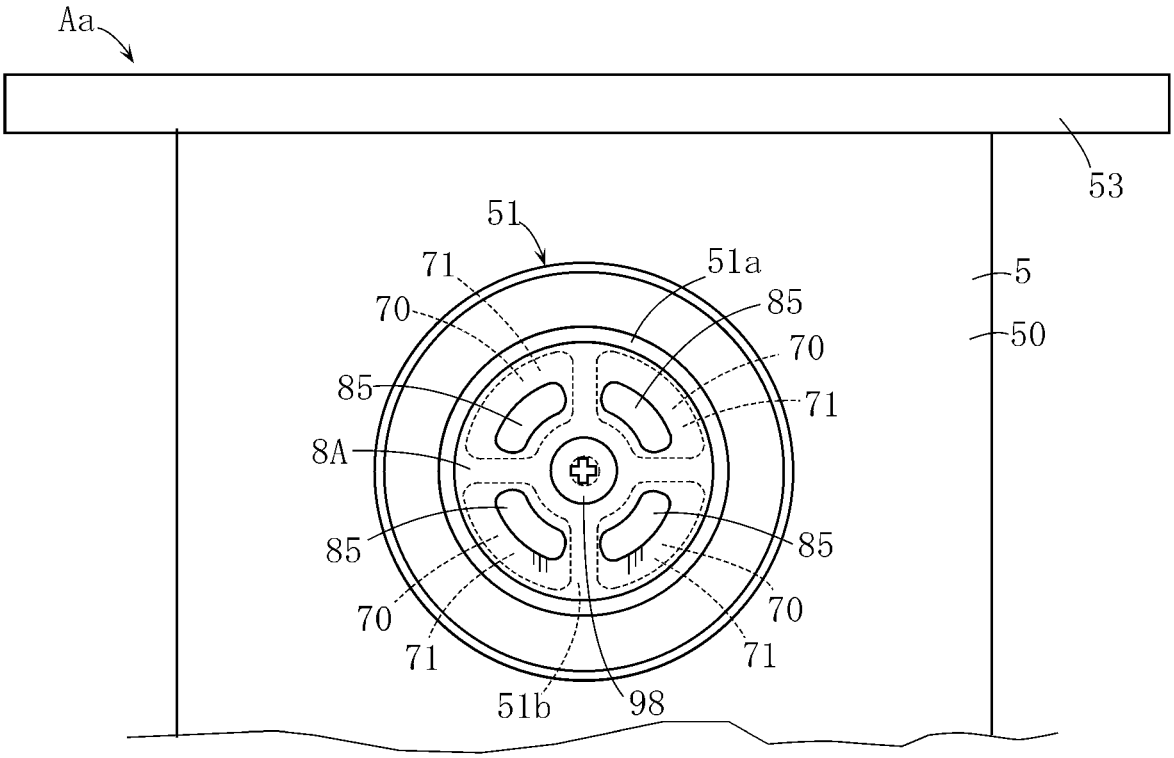
FIG. 12 is a front view of a main part of the premixing device illustrated in FIG. 10.
Figure 13:
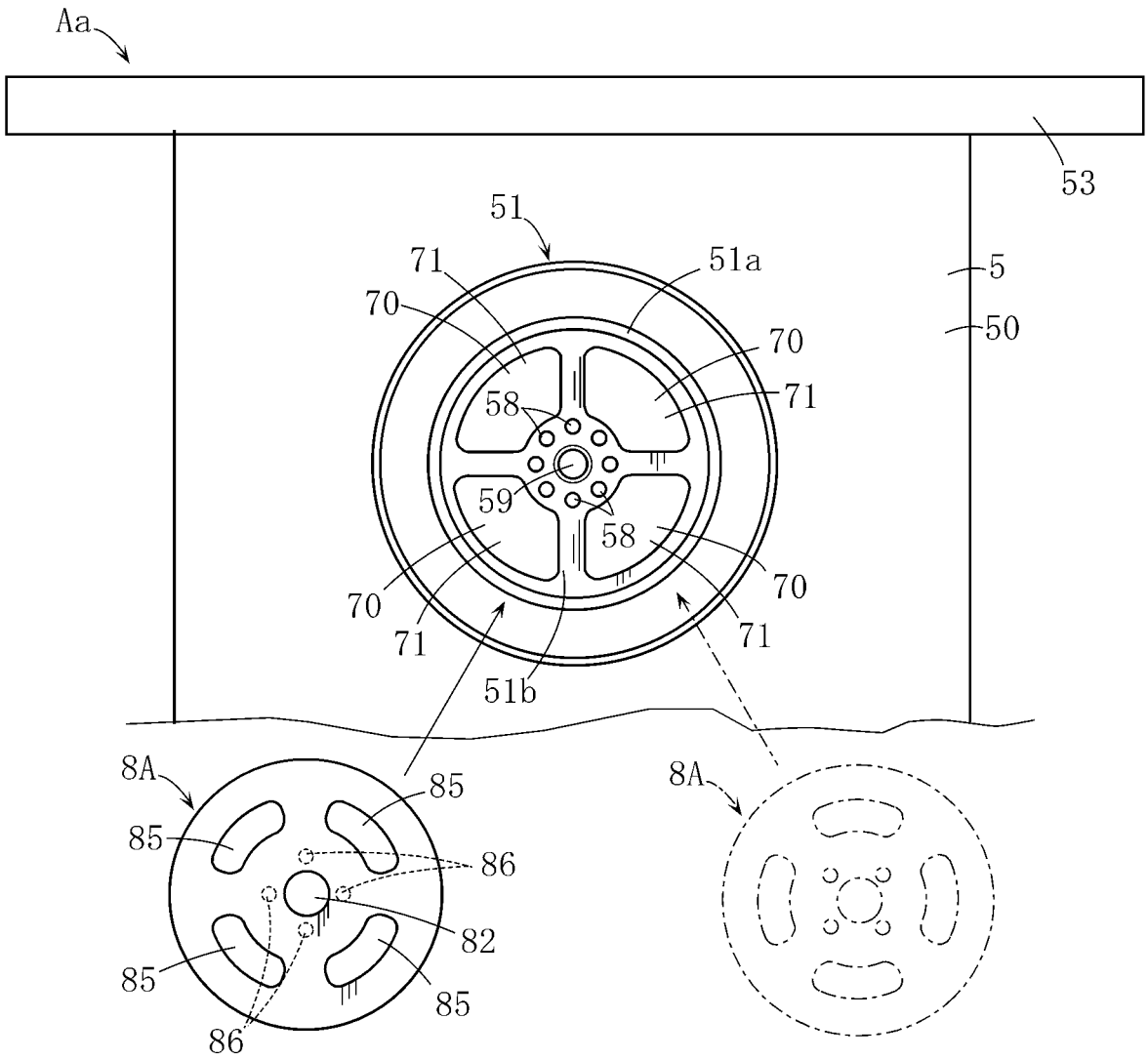
FIG. 13 is an exploded front view of the main part of FIG. 12.

As illustrated in FIGS. 10 to 12, the premixing device Aa of the present embodiment has a configuration in which the fuel gas flow path adjusting member 8A is attached to the inner sidewall part 51*b* of the pipe joint part 51 using a screw body 98. However, when fuel gas is natural gas, the fuel gas flow path adjusting member 8A is set to the first attachment mode illustrated in FIG. 12. The first attachment mode is in a state in which all the plurality of openings 85 overlaps the plurality of fuel gas supply ports 70, and an effective opening area of the plurality of fuel gas supply ports 70 is equal to a total area of the plurality of openings 85.

Figure 14:
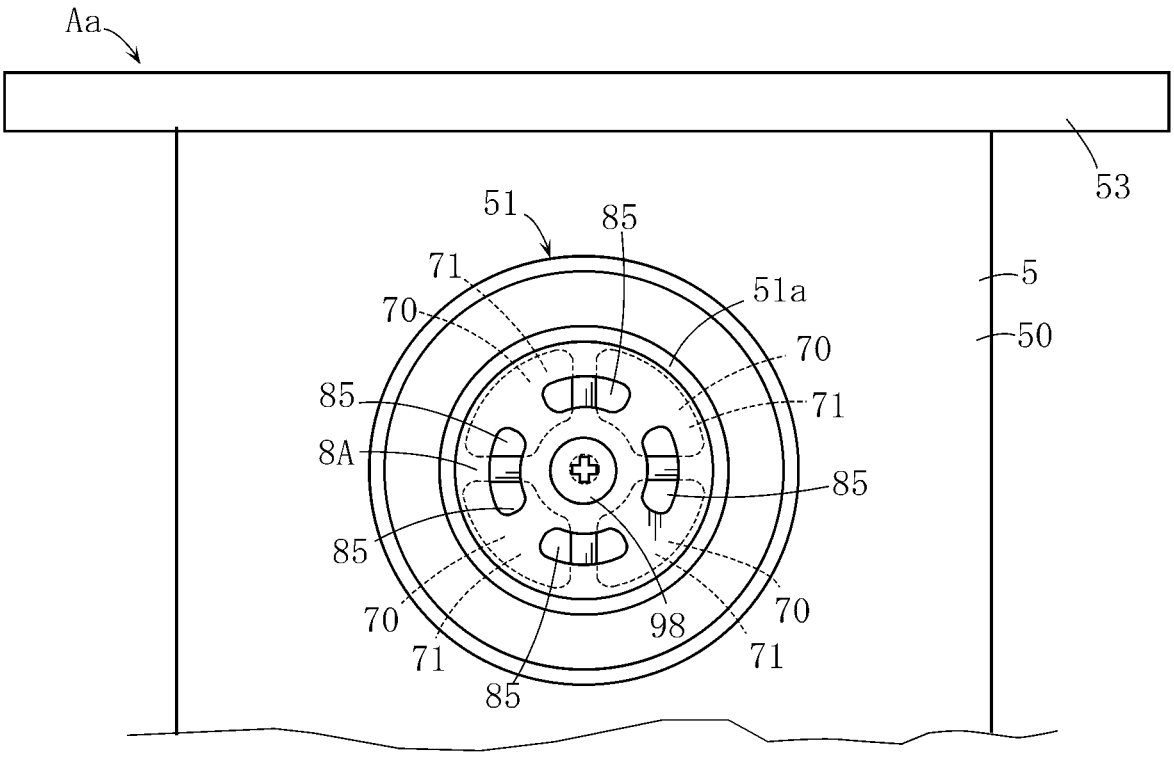
FIG. 14 is a front view of a main part illustrating an example in which a fuel gas flow path adjusting member is set to a mode different from that of FIG. 12.

In contrast, when fuel gas is LP gas, the fuel gas flow path adjusting member 8A is set to the second attachment mode illustrated in FIG. 14. In the second attachment mode, a part of each of the plurality of openings 85 overlaps a portion other than the fuel gas supply port 70, and all the plurality of openings 85 does not overlap the plurality of fuel gas supply ports 70. Therefore, in the second attachment mode, the effective opening area of the fuel gas supply ports 70 is small compared to that in the first attachment mode illustrated in FIG. 12, and this allows to appropriately respond to LP gas in which a heat generation rate is high.

In order to change from the first attachment mode illustrated in FIG. 12 to the second attachment mode illustrated in FIG. 14, the screw body 98 may be loosened and the fuel gas flow path adjusting member 8A may be rotated by an appropriate angle. At that time, the angle of the fuel gas flow path adjusting member 8A need only be set at a position at which the plurality of protruding parts 86 for positioning is fitted with the recessed parts 58. Therefore, the work of changing the attachment mode described above is also easy.

In a premixing device Ab illustrated in FIGS. 16 to 19, a plurality of parallel flow paths 71 is provided on an inner sidewall part 51*b* of a pipe joint part 51, and a plurality of fuel gas supply ports 70 as openings thereof is aligned to be positioned on a same circle. The parallel flow paths 71 and the fuel gas supply ports 70 have smaller area than the parallel flow paths 71 and the fuel gas supply ports 70 of the premixing device Aa of the above-described embodiment, and the number thereof provided is increased. A fuel gas flow path adjusting member 8B has a configuration in which openings 85, each having substantially the same shape and size as the fuel gas supply port 70, are provided to have the same number as the fuel gas supply ports 70. Also, a plurality of protruding parts 86 that can be fitted to a plurality of recessed parts 58 for positioning provided in the pipe joint part 51 is also provided.

Figure 16:
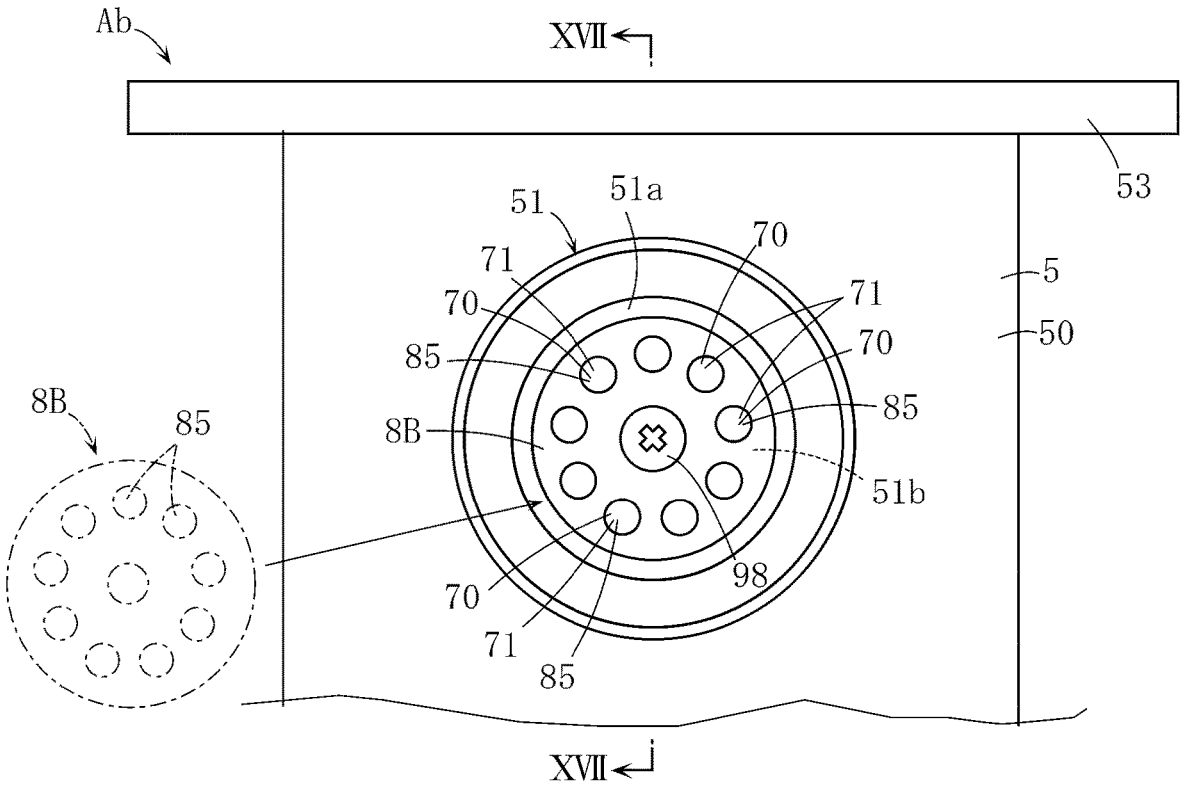
FIG. 16 is a front view of a main part illustrating another example of the premixing device according to the disclosure.
Figure 17A:
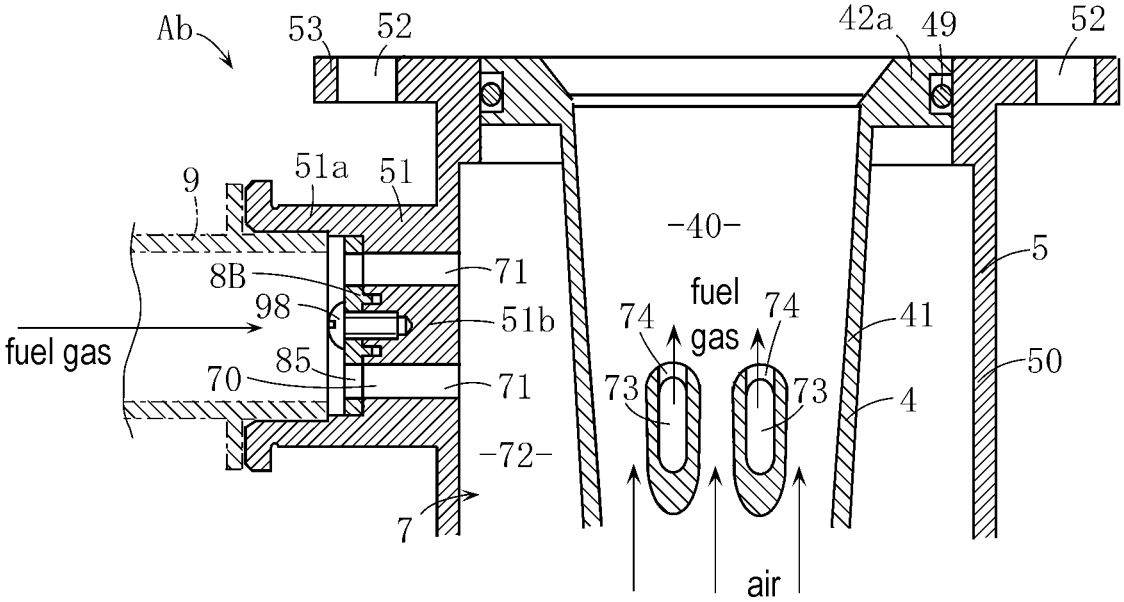
FIG. 17A is a cross-sectional view along line XVII-XVII of FIG. 16.
Figure 17B:
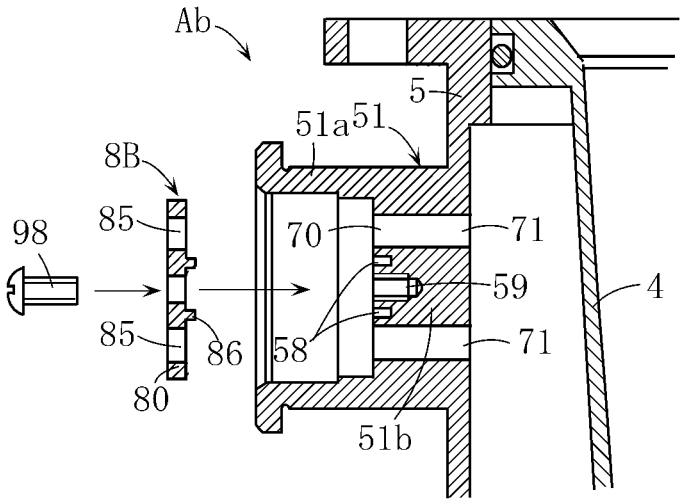
FIG. 17B is an exploded cross-sectional view of a main part of FIG. 17A.
Figure 18:
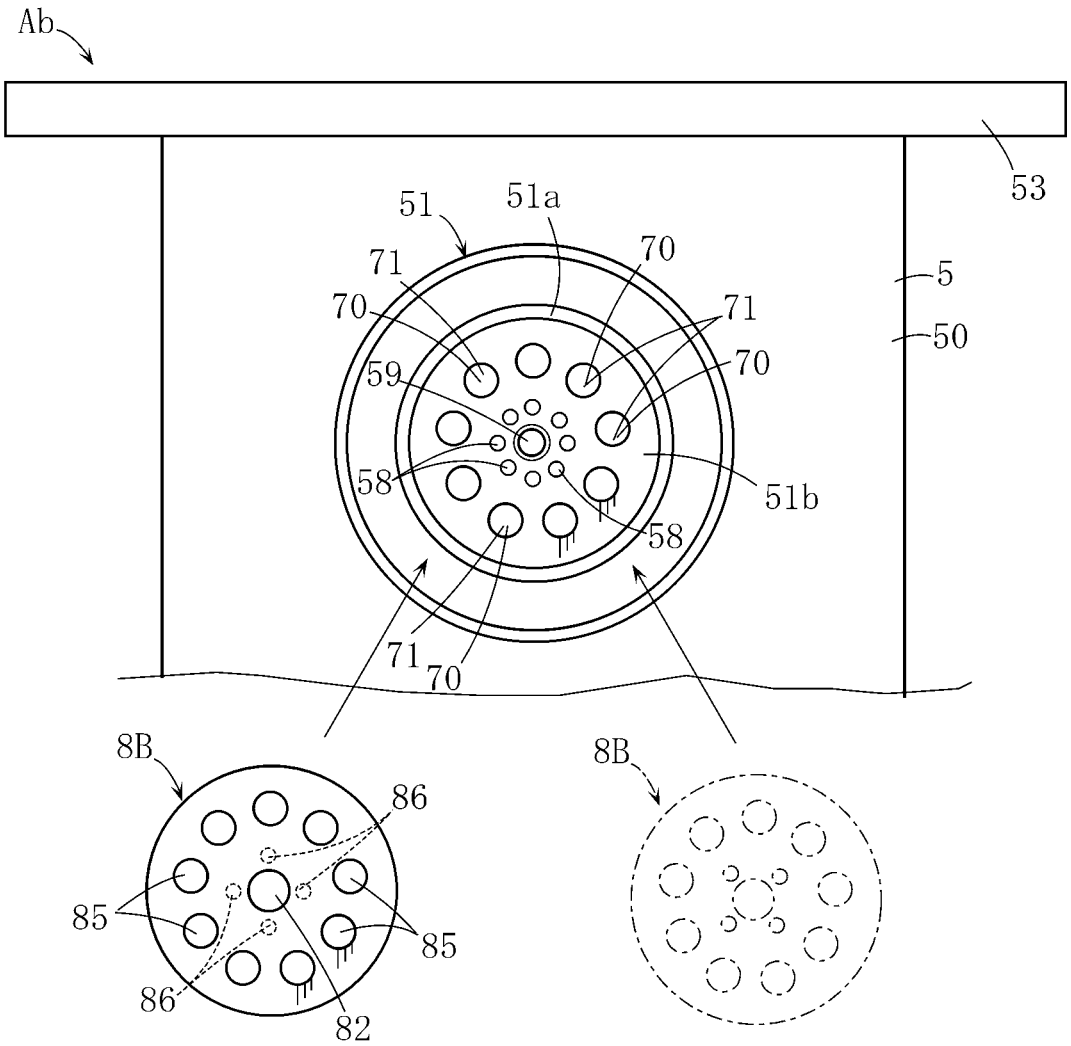
FIG. 18 is an exploded front view of a main part of FIG. 16.

In the premixing device Ab of the present embodiment, when fuel gas is natural gas, the fuel gas flow path adjusting member 8B is set to a first attachment mode illustrated in FIG. 16. The first attachment mode is in a state in which all the plurality of openings 85 overlaps the plurality of fuel gas supply ports 70, and all the plurality of fuel gas supply ports 70 is largely open. Therefore, it is suitable for natural gas in which a heat generation rate is low.

Figure 19:
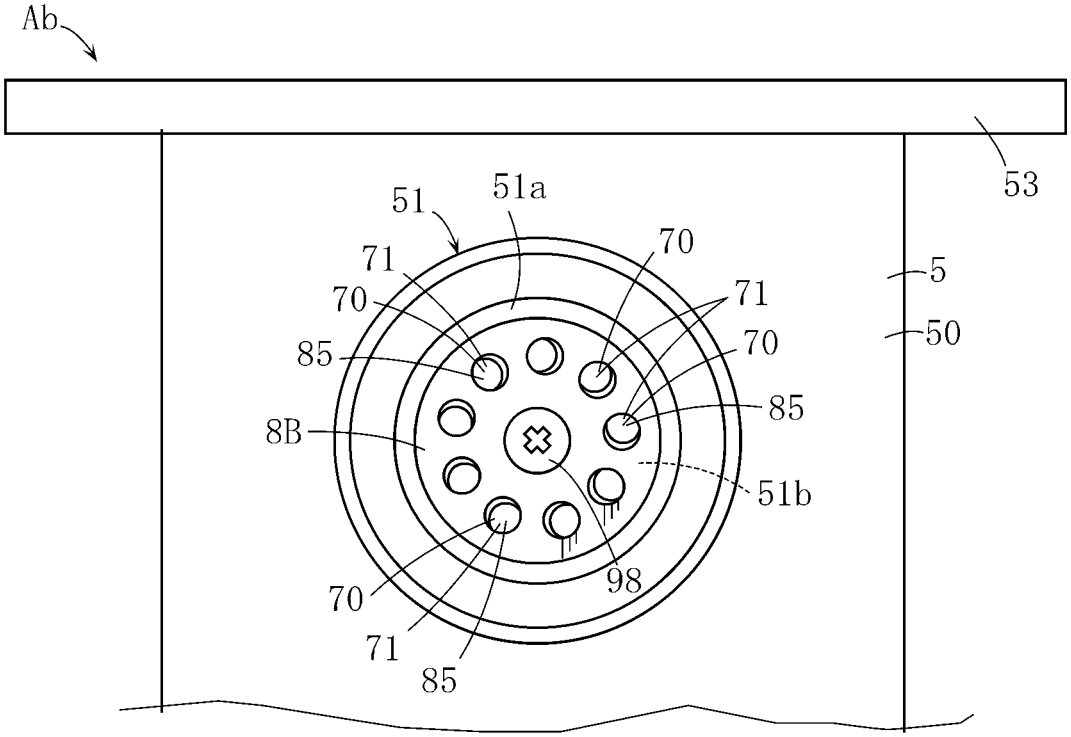
FIG. 19 is a front view of a main part illustrating an example in which the fuel gas flow path adjusting member is set to a mode different from that of FIG. 16.

In contrast, when fuel gas is LP gas, the fuel gas flow path adjusting member 8B is set to a second attachment mode illustrated in FIG. 19. In the second attachment mode, each of the fuel gas supply ports 70 and each of the openings 85 do not overlap in a completely coincident state, and a part of each fuel gas supply port 70 is closed. Therefore, it is suitable for LP gas in which a heat generation rate is high.

Also in the present embodiment, similarly to the premixing device Aa described above, a change in the attachment mode of the fuel gas flow path adjusting member 8B may be performed by loosening a screw body 98 and rotating the fuel gas flow path adjusting member 8B, and thus the work is easy. Also, in that case, when the plurality of protruding parts 86 and recessed parts 58 are fitted to each other, a rotation angle of the fuel gas flow path adjusting member 8B can be defined to be an accurate angle and thus it is convenient.

Figure 20:
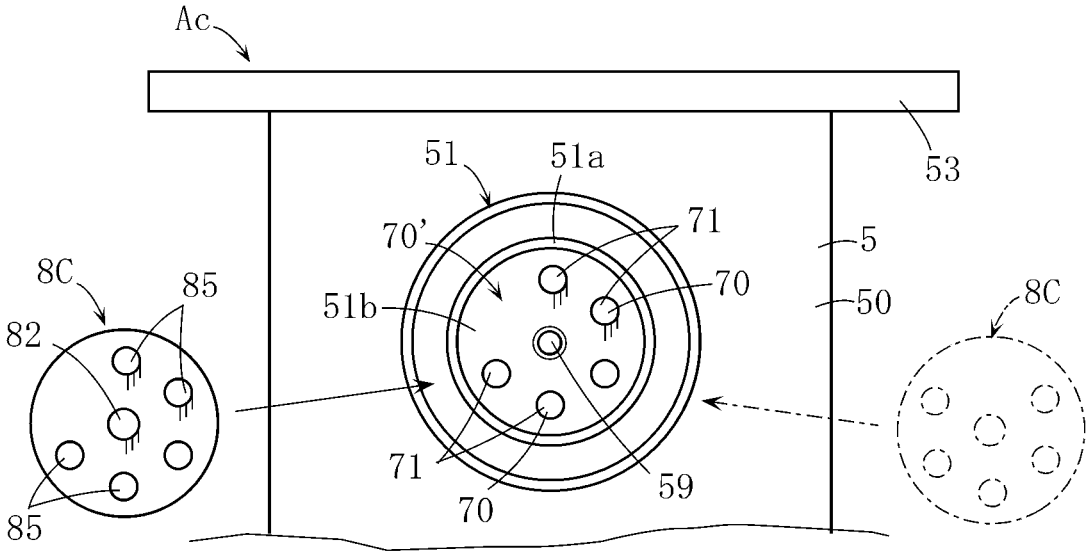
FIG. 20 is an exploded front view of a main part illustrating another example of the premixing device according to the disclosure.
Figure 21A:
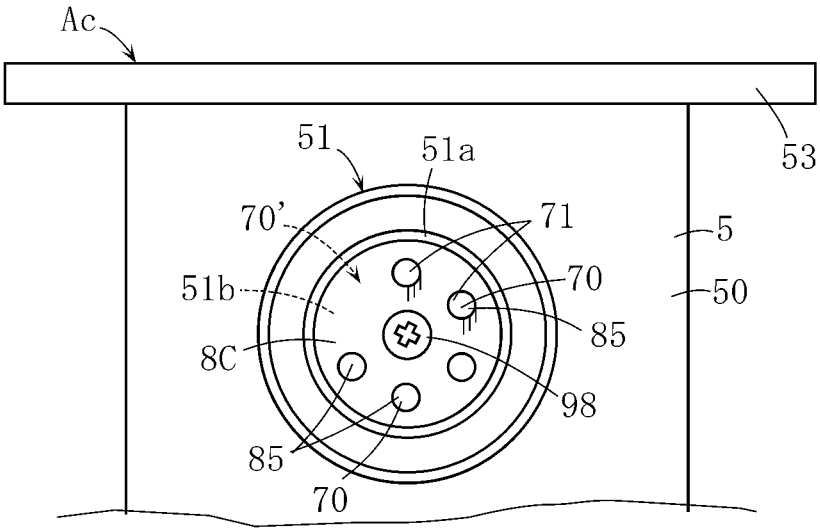
FIGS. 21A and 21B are front views of main parts illustrating a state in which the fuel gas flow path adjusting member is attached in the configuration illustrated in FIG. 20.
Figure 21B:
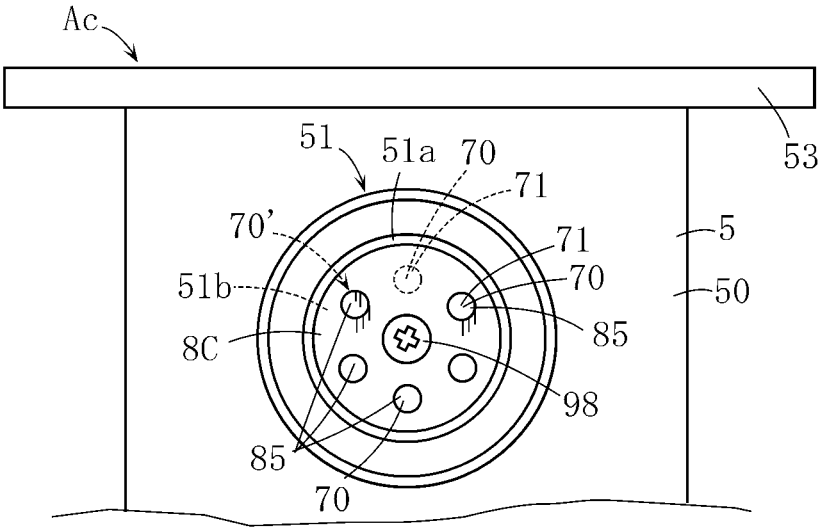

In a premixing device Ac illustrated in FIGS. 20 to 21B, a plurality of parallel flow paths 71 is provided on an inner sidewall part 51*b* of a pipe joint part 51, and a plurality of fuel gas supply ports 70 as openings thereof is provided. Although the plurality of fuel gas supply ports 70 is aligned to be positioned on a same circle, these are not disposed at equal intervals and there is an unequally spaced portion 70' (a slightly broadened region in which the fuel gas supply port 70 is not provided).

A fuel gas flow path adjusting member 8C has a plurality of openings 85 having substantially the same shape, size, and disposition as the plurality of fuel gas supply ports 70.

In the premixing device Ac, when fuel gas is natural gas, the fuel gas flow path adjusting member 8C is set to a first attachment mode illustrated in FIG. 21A. In the first attachment mode, all the plurality of fuel gas supply ports 70 overlaps the openings 85 and are in a state of being largely open. In contrast, when fuel gas is LP gas, the fuel gas flow path adjusting member 8C is set to a second attachment mode illustrated in FIG. 21B. In the second attachment mode, one opening 85 is positioned at the unequally spaced portion 70', and of the plurality of fuel gas supply ports 70, one fuel gas supply port 70 is closed by the fuel gas flow path adjusting member 8C. Therefore, the present embodiment also can appropriately respond to any case regardless of whether fuel gas is natural gas or LP gas. A change in the attachment mode of the fuel gas flow path adjusting member 8C may be performed by loosening a screw body 98 and rotating the fuel gas flow path adjusting member 8C, and thus the work is easy.

In a premixing device Ad illustrated in FIGS. 22 to 25B, a plurality of parallel flow paths is not provided in a pipe joint part 51, and one hole 71C forming a part of a fuel gas flow path 7 is provided. An opening of the hole 71C is a fuel gas supply port 70. The fuel gas supply port 70 is disposed to be biased in one direction (rightward in the drawing) from a central portion of an inner sidewall part 51*b* of the pipe joint part 51. On the other hand, a fuel gas flow path adjusting member 8D has a configuration in which two openings 85*a* and 85*b* having different diameters and two screw body insertion holes 82 are provided in a disc-shaped main body part 80.

Figure 22:
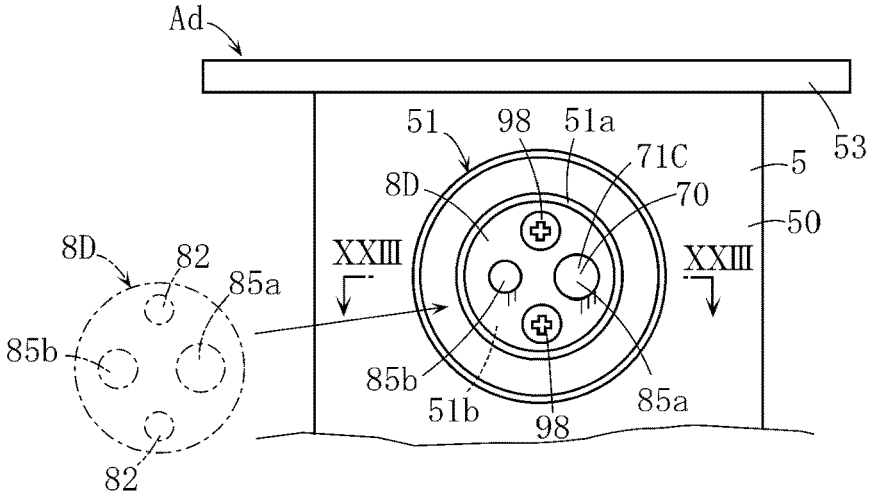
FIG. 22 is a front view of a main part illustrating another example of the premixing device according to the disclosure.
Figure 23:
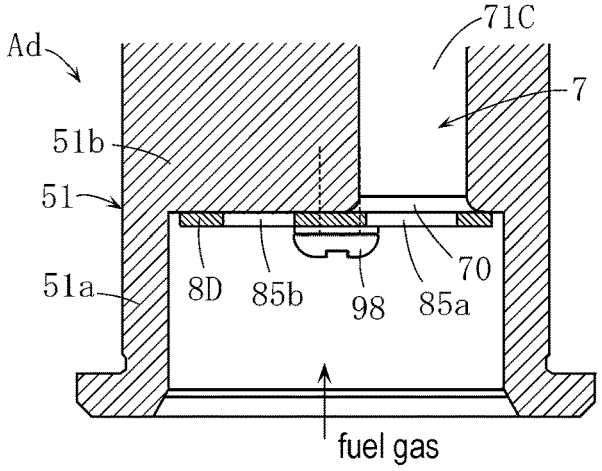
FIG. 23 is a cross-sectional view of a main part along line XXIII-XXIII of FIG. 22.
Figure 24:
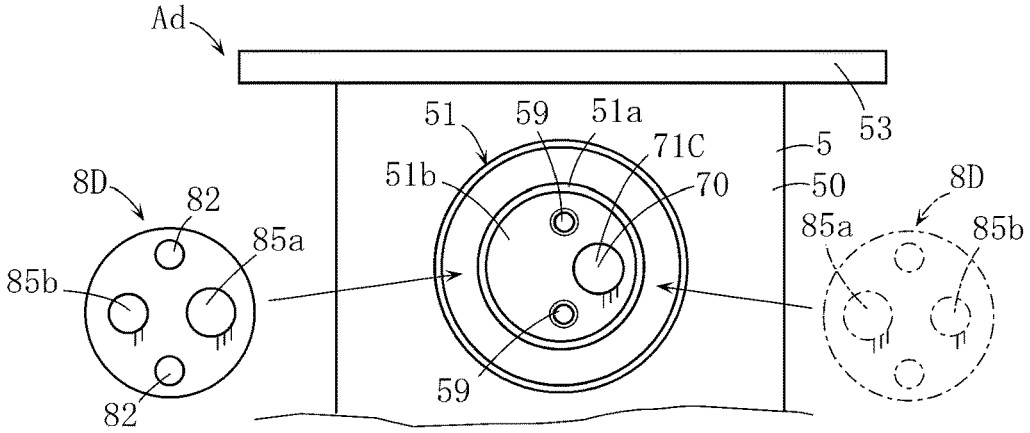
FIG. 24 is an exploded front view of a main part of FIG. 22.
Figure 25A:
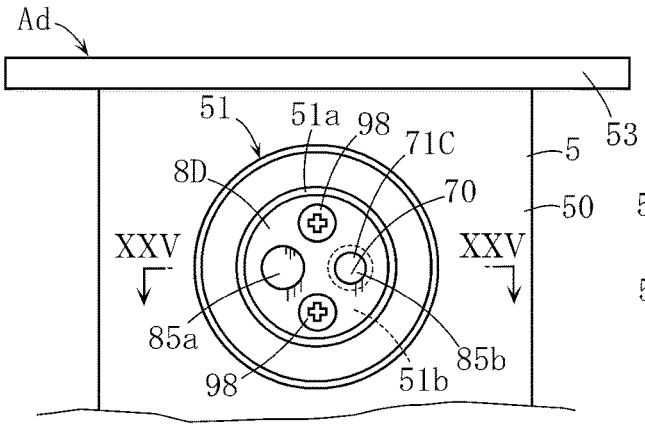
FIGS. 25A and 25B illustrate an example in which the fuel gas flow path adjusting member is set to a mode different from that of FIG. 22.
Figure 25B:
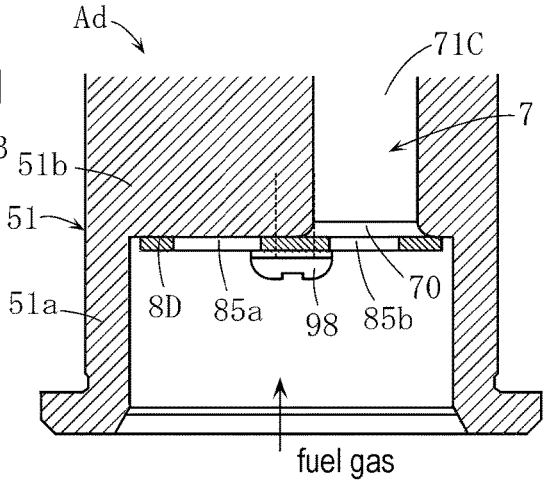

FIGS. 22 and 23 illustrate a first attachment mode of the fuel gas flow path adjusting member 8D. In the first attachment mode, the opening 85*a* on a large-diameter side of the fuel gas flow path adjusting member 8D overlaps the fuel gas supply port 70. On the other hand, FIGS. 25A and 25B illustrate a second attachment mode of the fuel gas flow path adjusting member 8D. In the second attachment mode, the opening 85*b* on a small-diameter side of the fuel gas flow path adjusting member 8D overlaps the fuel gas supply port 70.

An effective opening area of the fuel gas supply port 70 is large in the first attachment mode and small in the second attachment mode, and thus an action intended by the disclosure can be obtained. Switching between the first and second attachment modes may be performed by loosening a screw body 98, temporarily removing the fuel gas flow path adjusting member 8D, and then reversing and reattaching the fuel gas flow path adjusting member 8D, and thus the work is easy.

According to the present embodiment, since there is no need to provide a plurality of parallel flow paths, the fuel gas flow path 7 can be simplified.

In a premixing device Ae illustrated in FIGS. 26A to 28B, one hole 71D forming a part of a fuel gas flow path 7 is provided in a pipe joint part 51. The hole 71D has a long hole shape, and an opening thereof is a fuel gas supply port 70. On the other hand, a fuel gas flow path adjusting member 8E has a configuration in which a circular opening 85 is provided at a position biased from a center of a disc-shaped main body part 80.

Figure 26A:
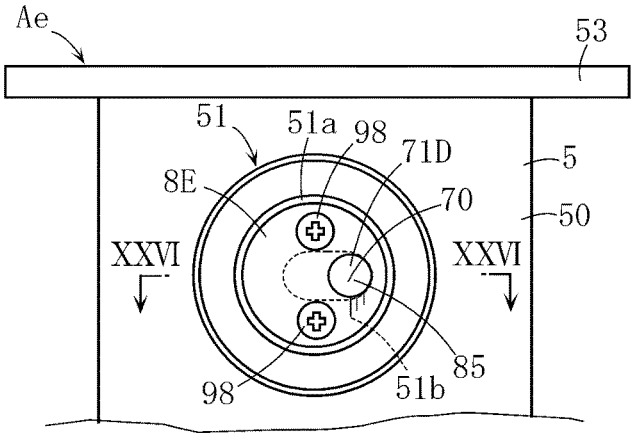
FIGS. 26A and 26B illustrate another example of the premixing device according to the disclosure.
Figure 26B:
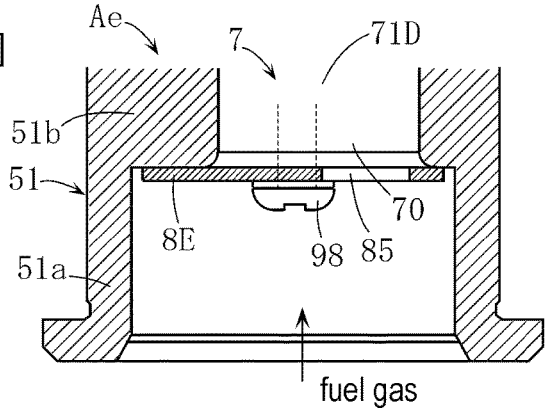
Figure 27:
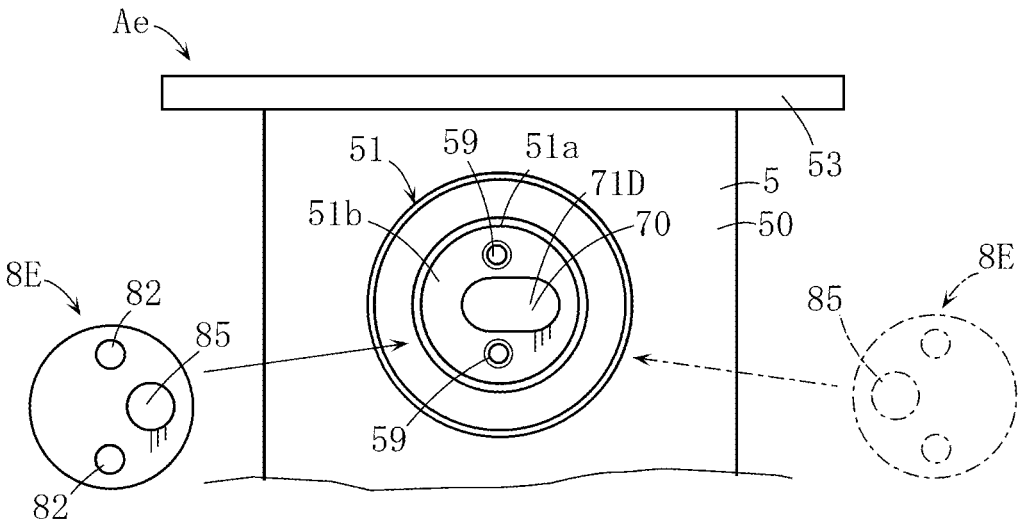
FIG. 27 is an exploded front view of a main part of FIG. 26A.

FIGS. 26A and 26B illustrate a first attachment mode of the fuel gas flow path adjusting member 8E. In this first attachment mode, substantially the entire opening 85 of the fuel gas flow path adjusting member 8E is made to face a part of the fuel gas supply port 70 so that the fuel gas supply port 70 is closed by the fuel gas flow path adjusting member 8E.

Figure 28A:
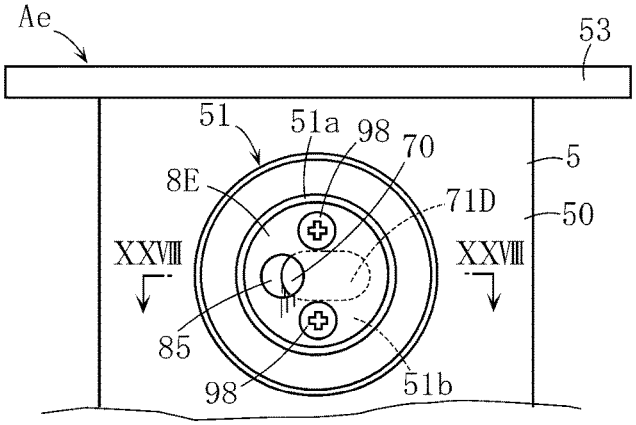
FIGS. 28A and 28B illustrate an example in which the fuel gas flow path adjusting member is set to a mode different from that of FIGS. 26A and 26B.
Figure 28B:
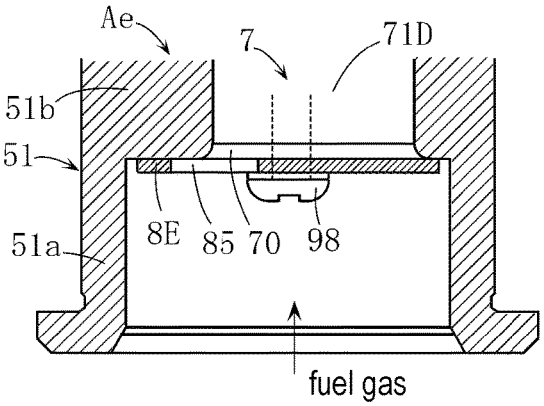

FIGS. 28A and 28B illustrate a second attachment mode of the fuel gas flow path adjusting member 8E. In the second attachment mode, only a part of the opening 85 of the fuel gas flow path adjusting member 8E is made to face a part of the fuel gas supply port 70 so that the fuel gas supply port 70 is closed by the fuel gas flow path adjusting member 8E.

Also in the present embodiment, as in the above-described embodiment, an effective opening area of the fuel gas supply port 70 is large in the first attachment mode and small in the second attachment mode. The first attachment mode is suitable for natural gas, and the second attachment mode is suitable for LP gas. Also, similarly to the premixing device Ad described above, there is no need to provide a plurality of parallel flow paths, and the fuel gas flow path 7 can be simplified.

Figure 29:
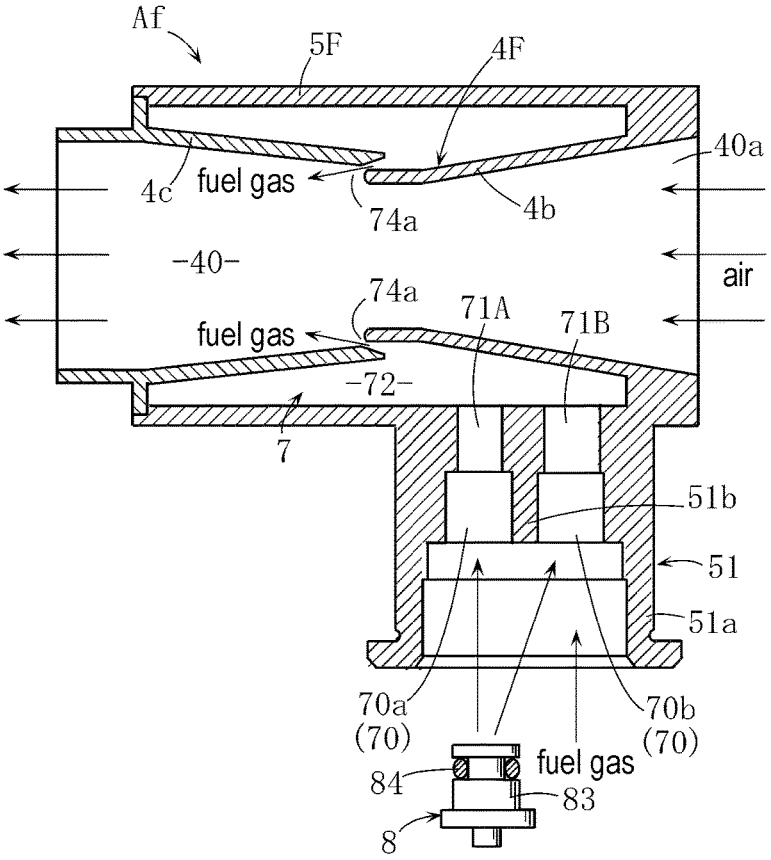
FIG. 29 is an exploded cross-sectional view of a main part illustrating another example of the premixing device according to the disclosure.

In a premixing device Af illustrated in FIG. 29, a premixing flow path forming member 4F is configured to utilize first and second tubular parts 4*b* and 4*c*. An opening 40*a* for air inflow is provided at a base end portion of the first tubular part 4*b*, and the inside of the first and second tubular parts 4*b* and 4*c* is a premixing flow path 40. A fuel gas outlet 74*a* as a gap that opens to the premixing flow path 40 is provided between a distal end portion of the first tubular part 4*b* and a base end portion of the second tubular part 4*c*. Fuel gas supplied to a pipe joint part 51 passes through a region 72 provided between the first and second tubular parts 4*b* and 4*c* and a housing member 5F and then reaches the fuel gas outlet 74*a*.

Although the pipe joint part 51 is provided to the housing member 5F, two parallel flow paths 71A and 71B similar to, for example, those illustrated in FIGS. 4A and 4B are provided in the pipe joint part 51. Also, either one of two fuel gas supply ports 70 (70*a*, 70*b*), which are openings of the parallel flow paths 71A and 71B, can be selectively closed by a fuel gas flow path adjusting member 8.

In the present embodiment, a negative pressure is generated in the vicinity of the fuel gas outlet 74*a* due to air flowing through the venturi-shaped premixing flow path 40, and fuel gas flows out from the fuel gas outlet 74*a* into the premixing flow path 40. Unlike the above-described embodiment, a blade part 6 in which a fuel gas outlet 74 is provided is not used, but an air-fuel mixture of air and fuel gas can be appropriately generated. The premixing flow path and the premixing flow path forming member of the disclosure can also be configured as in the present embodiment.

Figure 30A:
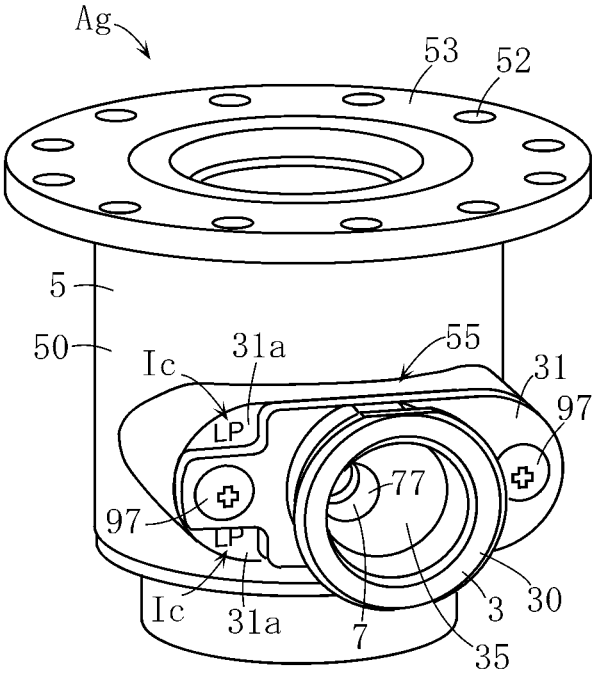
FIG. 30A is a perspective view illustrating another example of the premixing device according to the disclosure.
Figure 30B:
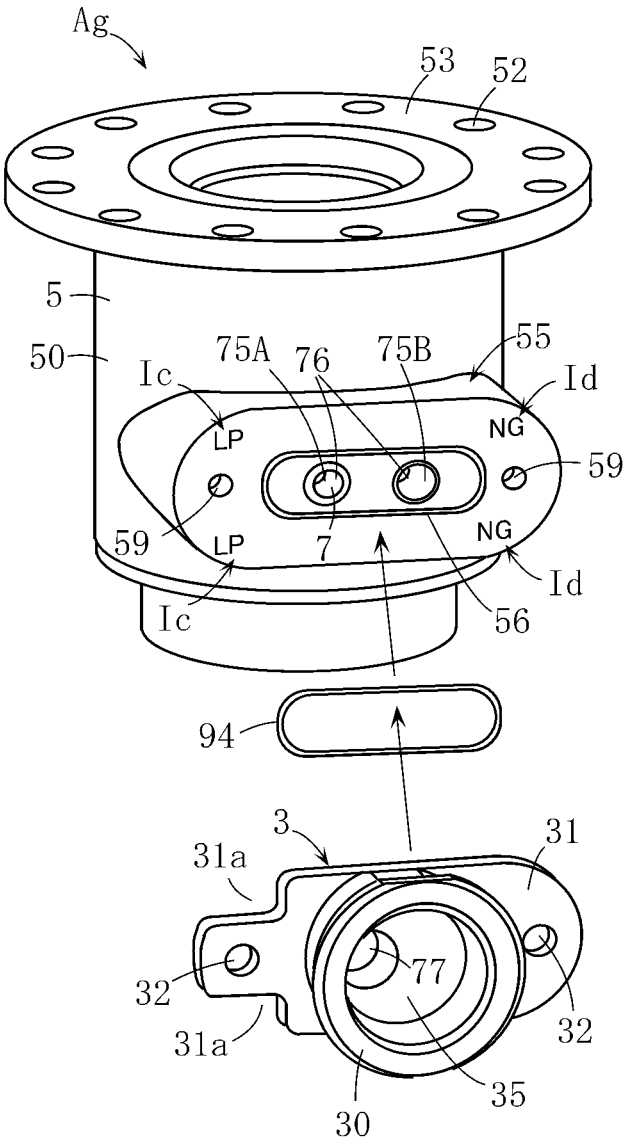
FIG. 30B is an exploded perspective view of FIG. 30A.
Figure 31:
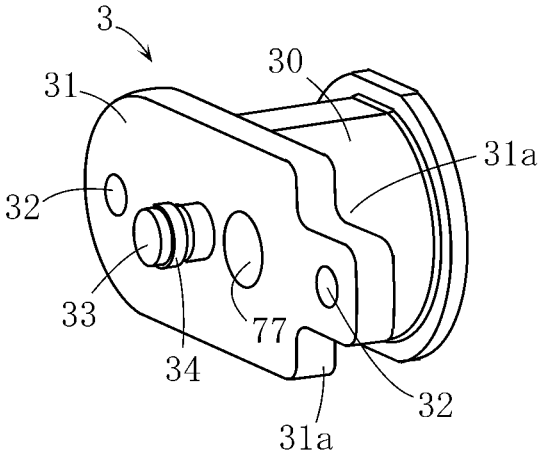
FIG. 31 is a perspective view from an inner surface side of a pipe joint part of the premixing device illustrated in FIGS. 30A and 30B.
Figure 32A:
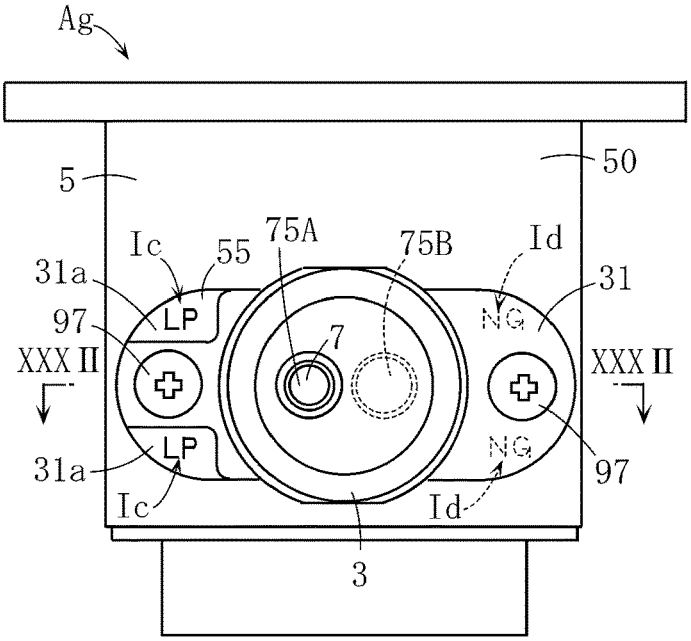
FIG. 32A is a front view of FIG. 30A.
Figure 32B:
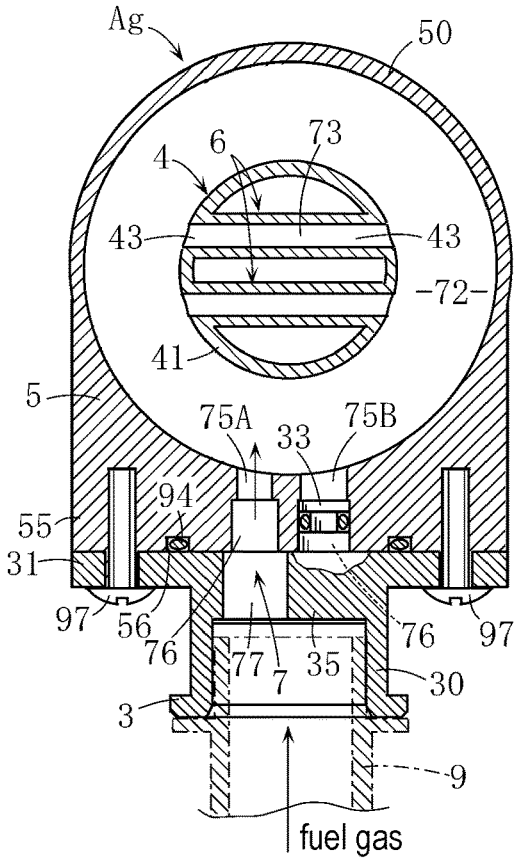
FIG. 32B is a cross-sectional view along line XXXII-XXXII of FIG. 32A.

In a premixing device Ag illustrated in FIGS. 30A and 30B, unlike the embodiments illustrated in FIGS. 1 to 29, flow path resistance of a fuel gas flow path 7 can be changed by providing a pipe joint part 3 and changing an attachment mode of the pipe joint part 3.

Specifically, in the premixing device Ag, a base part 55 is provided to a housing member 5, and the pipe joint part 3 for connecting a gas pipe 9 is attached to an outer surface portion of the base part 55.

The base part 55 has a front surface portion having a planar shape suitable for attachment of the pipe joint part 3 and includes two holes 75A and 75B (base side holes 75A and 75B) that form a part of the fuel gas flow path 7, a pair of left and right screw holes 59, a packing groove part 56 to which a sealing packing 94 is attached, and first and second gas type display portions 1*c* and 1*d*.

Further, unlike the first gas type display portion 1*a* described above, the first gas type display portion 1*c* is displayed with characters "LP" indicating that fuel gas is LP gas, and unlike the second gas type display portion 1*b* described above, the second gas type display portion 1*d* is displayed with characters "NG" indicating that fuel gas is natural gas.

Figure 33:
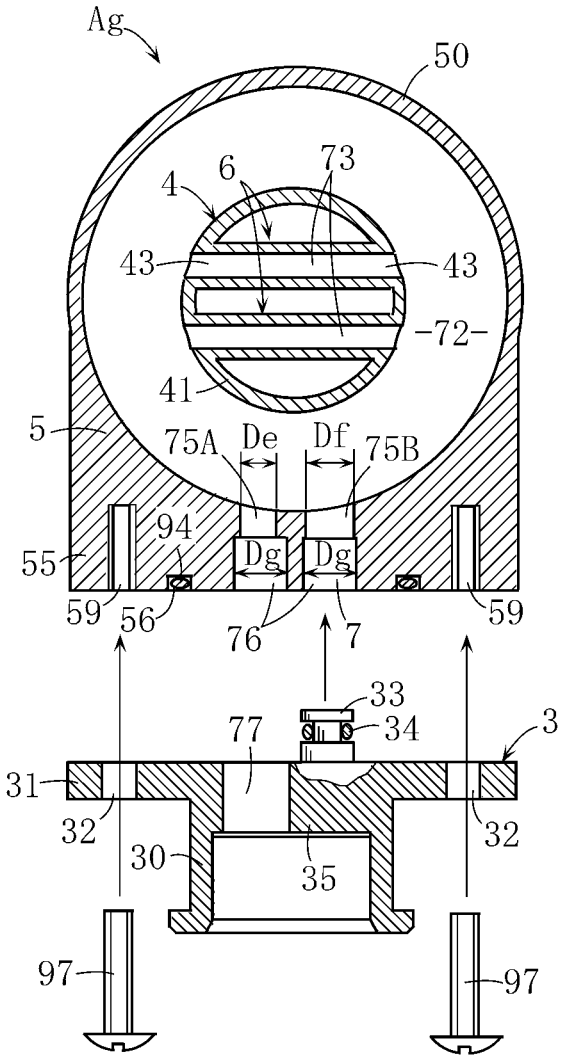
FIG. 33 is an exploded cross-sectional view of FIG. 32B.

As illustrated in FIG. 33, the two base side holes 75A and 75B have different inner diameters De and Df having a relationship of De<Df. The inner diameter De is a flow path inner diameter that is suitable when LP gas is used as fuel gas. The inner diameter Df is a flow path inner diameter that is suitable when natural gas is used as fuel gas. However, inner diameters Dg of portions 76 (portions 76 of the base side holes 75A and 75B close to the pipe joint part 3) into which a sealing protruding part 33 of the pipe joint part 3, which will be described later, is fitted have a dimension larger than the above-described inner diameters De and Df and have the same dimension.

The pipe joint part 3 includes a cylindrical part 30 having an open distal end, a plate part 31 connected to a base end portion of the cylindrical part 30, and an inner sidewall part 35 provided at an innermost portion of the cylindrical part 30. A hole 77 (joint side hole 77) forming a part of the fuel gas flow path 7 is provided in the inner sidewall part 35, and the sealing protruding part 33 is provided to protrude on the inner sidewall part 35 (see also FIG. 31). A sealing O-ring 34 is attached to the sealing protruding part 33. The joint side hole 77 and the sealing protruding part 33 are disposed to correspond to the two base side holes 75A and 75B.

The pipe joint part 3 is attached to the base part 55 so that the plate part 31 is in face-to-face contact with a front surface portion of the base part 55. As this attachment method, for example, a method in which screw bodies 97 such as screws inserted into a pair of screw body insertion holes 32 provided in the plate part 31 are screwed into the screw holes 59 of the base part 55 to fasten the plate part 31 is used. The sealing packing 94 is sandwiched between the pipe joint part 3 and the base part 55 and compressed to help prevent fuel gas from leaking. The sealing packing 94 and the packing groove part 56 have a loop shape that surrounds the two base side holes 75A and 75B.

The attachment mode of the pipe joint part 3 with respect to the base part 55 can be selectively set to either one of a first attachment mode or a second attachment mode to be described later.

In the first attachment mode of the pipe joint part 3, as illustrated in FIGS. 30A, 30B, 32A, and 32B, of the two base side holes 75A and 75B, one base side hole 75A faces the joint side hole 77 to communicates therewith. The other base side hole 75B is in a state in which it is fitted and closed by the sealing protruding part 33.

On one end side of the plate part 31 of the pipe joint part 3, a notch part 31*a* in which a width of the one end side is made small is provided, and in the first attachment mode, the notch part 31*a* of the plate part 31 exposes the characters "LP" which are the first gas type display portion 1*c*. On the other hand, the characters "NG" which are the second gas type display portion 1*d* are covered and hidden by the plate part 31.

Figure 34A:
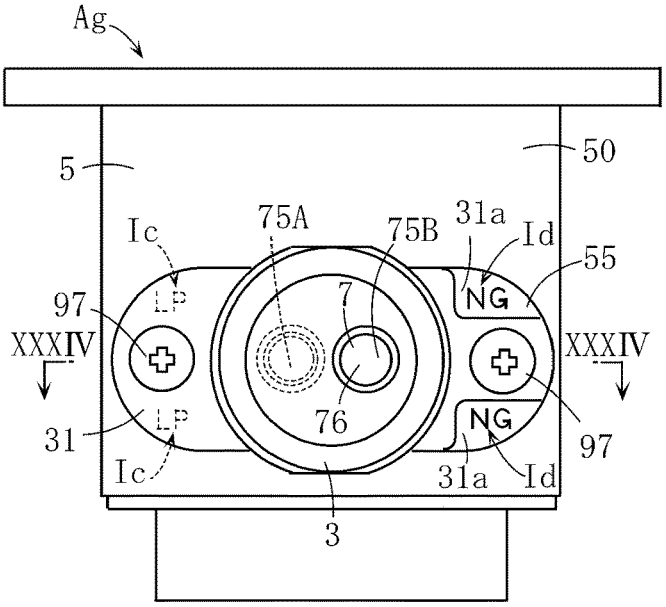
FIG. 34A is a front view of a state in which the pipe joint part is set to a mode different from that of FIG. 32A.
Figure 34B:
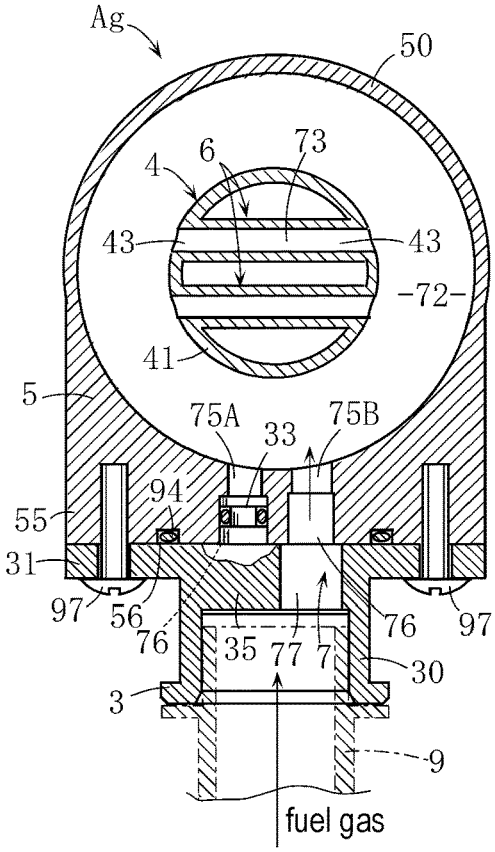
FIG. 34B is a cross-sectional view along line XXXIV-XXXIV of FIG. 34A.

In the second attachment mode of the pipe joint part 3, as illustrated in FIGS. 34A and 34B, the pipe joint part 3 is attached to the base part 55 in a direction laterally reversed from that of the first attachment mode described above. In the second attachment mode, the base side hole 75B faces the joint side hole 77 to communicates therewith. Also, the base side hole 75A is in a state in which it is fitted and closed by the sealing protruding part 33. Since a position of the notch part 31*a* of the plate part 31 is laterally reversed from the case of the first attachment mode, the characters "NG" which are the second gas type display portion 1*d* are exposed and the characters "LP" which are the first gas type display portion 1*c* are in a state covered and hidden by the plate part 31.

Next, the operation of the above-described premixing device Ag will be described.

First, when fuel gas is, for example, LP gas as an environment in which the premixing device Ag is used, the pipe joint part 3 is set to the above-described first attachment mode as illustrated in FIGS. 30A, 30B, 32A, and 32B. In the first attachment mode, as illustrated in FIGS. 30A, 30B, 32A, and 32B, the base side hole 75B is closed by the pipe joint part 3, and the base side hole 75A faces the joint side hole 77 to communicate therewith. However, since the inner diameter De of the base side hole 75A is on the small side, the flow path resistance of the fuel gas flow path 7 increases. Here, since LP gas has a higher heat generation rate than natural gas, an amount of gas with respect to air needs to be decreased than that when natural gas is used, but according to the first attachment mode described above, since the flow path resistance of the fuel gas flow path 7 increases, a setting state suitable for LP gas is obtained.

On the other hand, when fuel gas is natural gas, it is changed to the second attachment mode as illustrated in FIGS. 34A and 34B. Since the change from the first attachment mode to the second attachment mode need only loosen the screw body 97, change a direction of the pipe joint part 3, and reattach the pipe joint part 3 to the base part 55, the work can be easily and quickly performed.

In the second attachment mode, contrary to the first attachment mode, the base side hole 75A is closed by the pipe joint part 3, and the base side hole 75B faces the joint side hole 77 to communicates therewith. The inner diameter Df of the base side hole 75B is on the large side, and the flow path resistance of the fuel gas flow path 7 can be reduced. Since a heat generation rate of natural gas is lower than that of LP gas, it is necessary to reduce the flow path resistance and increase an amount of gas with respect to air, but it is possible to appropriately respond to such a need according to the second attachment mode.

As described above, according to the present embodiment, there is no need to replace parts or add new parts regardless of whether fuel gas is LP gas or natural gas. It is possible to appropriately respond to the above-described two types of fuel gas simply by changing the attachment mode of the pipe joint part 3. Therefore, as in the premixing devices A, and Aa to Af described above, there is no problem such as an increase in the number of parts in stock to respond to presence of two types of fuel gas, and costs incurred for inventory of parts can be reduced. Also, management of parts also becomes easier. The pipe joint part 3 is a portion originally included in the premixing device Ag, and since it is configured to be able to respond to types of fuel gas using the pipe joint part 3 in the present embodiment, the configuration of the pipe joint part 3 is rational and is possible in avoiding increase in the number of parts, increase in the overall size, or the like.

Further, according to the present embodiment, when the pipe joint part 3 is set to the first attachment mode, the second gas type display portion 1*d* is covered and hidden by the pipe joint part 3 while the characters "LP" which are the first gas type display portion 1*c* are in an exposed state. Conversely, when the pipe joint part 3 is set to the second attachment mode, the first gas type display portion 1*c* is covered and hidden while the characters "NG" which are the second gas type display portion 1*d* are in an exposed state. Therefore, when such a display is ascertained, it is possible to easily and accurately determine whether or not the attachment mode of the pipe joint part 3 is in an appropriate attachment mode that corresponds to actual types of fuel gas.

In a premixing device Ah illustrated in FIGS. 35 to 38, two joint side holes 77A and 77B are provided in a pipe joint part 3, and only one base side hole 75 is provided in a base part 55. Inner diameters D1 and D2 of the two joint side holes 77A and 77B are different from each other, for example, D1<D2.

Figure 35:
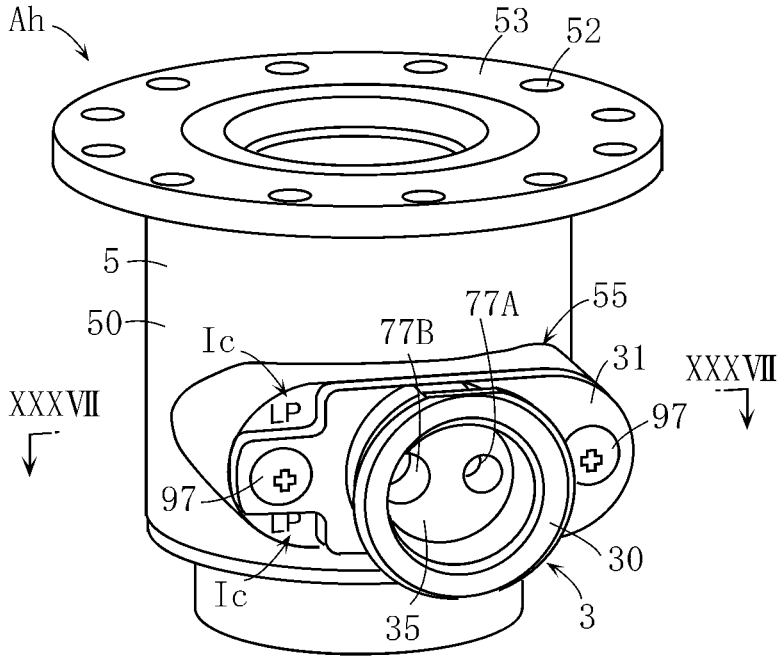
FIG. 35 is a perspective view illustrating another example of the premixing device according to the disclosure.
Figure 37:
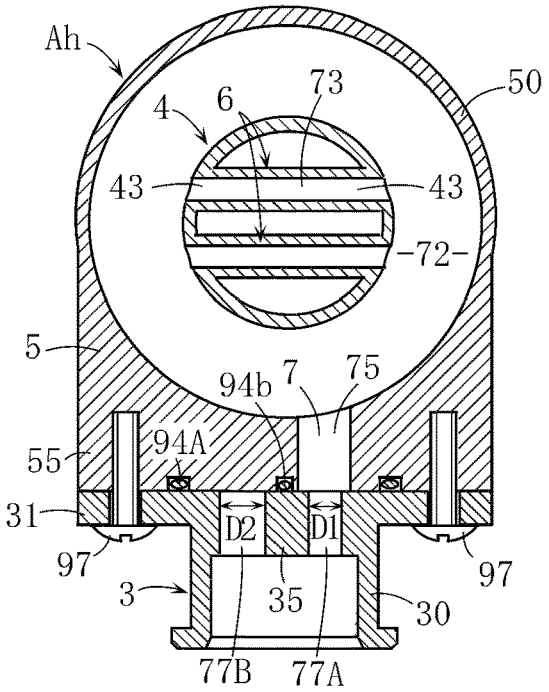
FIG. 37 is a cross-sectional view along line XXXVII-XXXVII of FIG. 35.

In the premixing device Ah, as illustrated in FIGS. 35 and 37, a first attachment mode of the pipe joint part 3 can be set to a state in which the joint side hole 77A is made to face the base side hole 75 to communicate therewith, and the side hole 77B is made not to communicate with the base side hole 75. According to the first attachment mode, since the inner diameter D of the joint side hole 77A is small, flow path resistance of the fuel gas flow path 7 can be increased, and this is suitable for LP gas.

Figure 38:
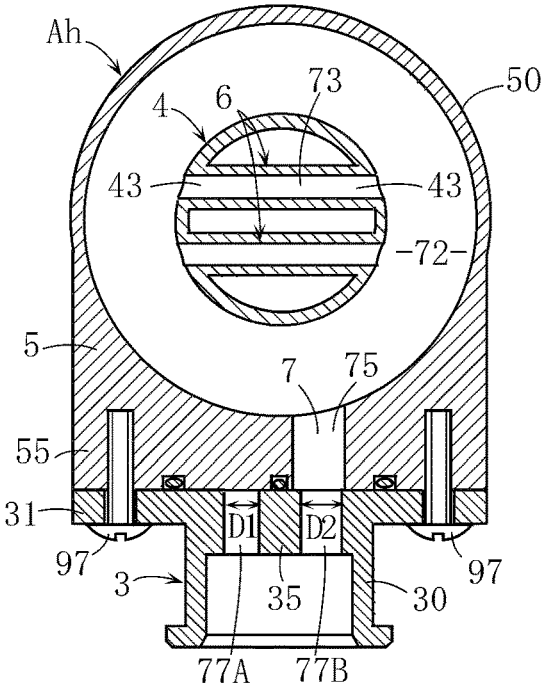
FIG. 38 is a cross-sectional view of a state in which the pipe joint part is set to a mode different from that of FIG. 37.

On the other hand, as illustrated in FIG. 38, contrary to the above, a second attachment mode of the pipe joint part 3 can be set to a state in which the joint side hole 77B is made to face the base side hole 75 to communicate therewith, and the joint side hole 77A is made not to communicate with the base side hole 75. According to the second attachment mode, since the inner diameter D2 of the joint side hole 77B is large, the flow path resistance of the fuel gas flow path 7 can be reduced, and this is suitable for natural gas.

In the premixing device Ah of the present embodiment, when compared to the premixing device Ag of the above-described embodiment illustrated in FIGS. 30A to 34B, a relationship between the base side hole 75 (75A, 75B) provided in the base part 55 and the joint side hole 77 (77A, 77B) provided in the pipe joint part 3 is opposite, but the same operation as the premixing device Ag of the above-described embodiment can be obtained.

Figure 36:
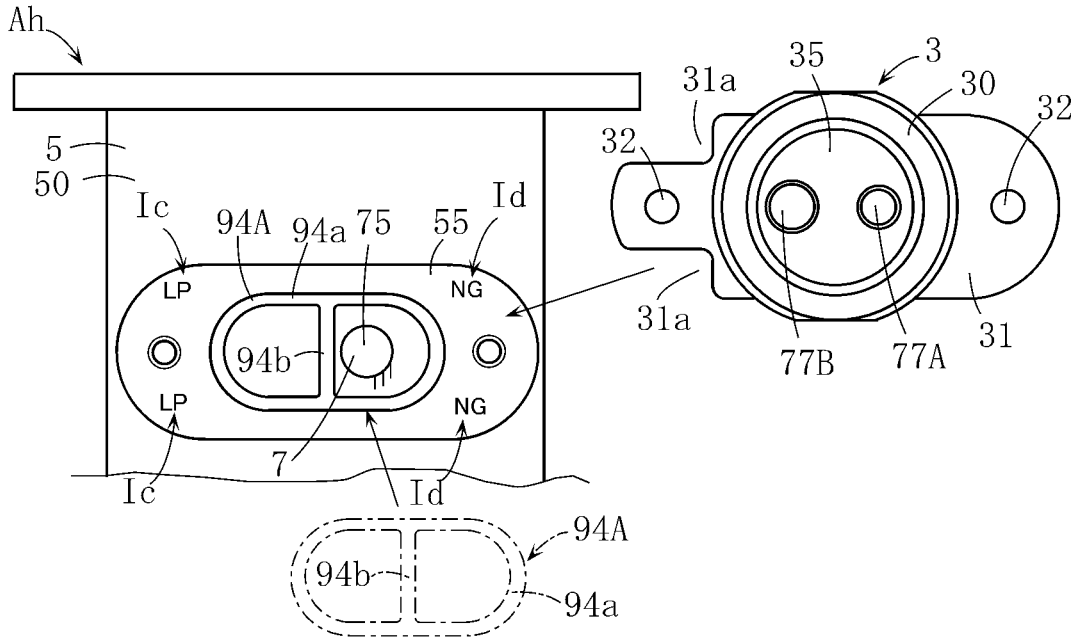
FIG. 36 is an exploded front view of a main part of the premixing device illustrated in FIG. 35.

In FIGS. 36 to 38, as a sealing packing 94A interposed between the base part 55 and the pipe joint part 3, a configuration including a linear portion 94*b* for disposing between the two joint side holes 77A and 77B is used in addition to the loop-shaped portion 94*a* that surrounds the entire facing region of the two joint side holes 77A and 77B. According to such a configuration, it is possible to appropriately prevent fuel gas from leaking between the two joint side holes 77A and 77B.

Figure 39:
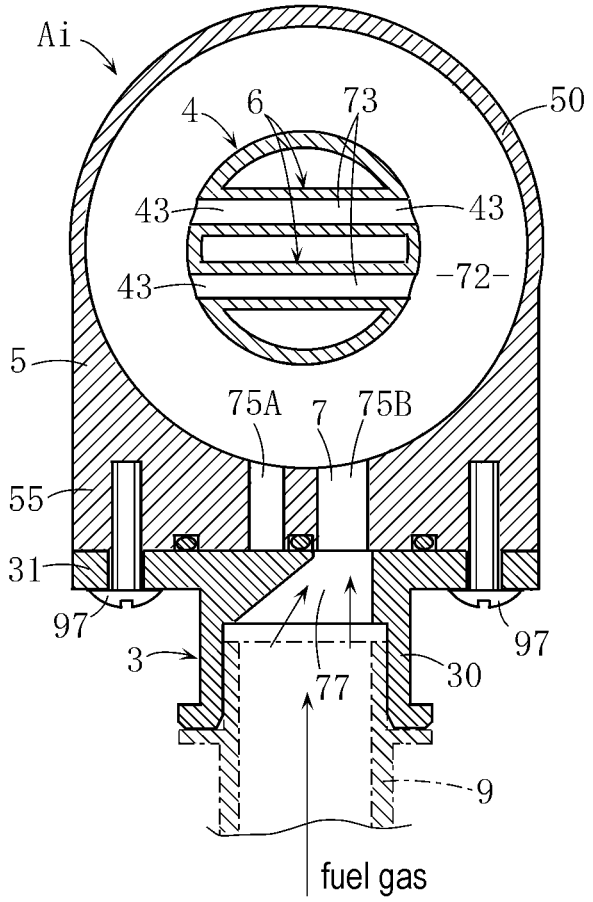
FIG. 39 is a cross-sectional view illustrating another example of the premixing device according to the disclosure.

In a premixing device Ai illustrated in FIG. 39, a joint side hole 77 is formed in a so-called tapered hole shape in a pipe joint part 3, and an inner diameter or a width of the joint side hole 77 decreases from a distal end side toward a base end side of the pipe joint part 3. In FIG. 39, the joint side hole 77 is illustrated in a state in which it faces and communicates with a base side hole 75B, but when the pipe joint part 3 is set to a laterally reversed attachment mode, the joint side hole 77 faces a base side hole 75A to communicates therewith.

According to the present embodiment, fuel gas supplied from a gas pipe 9 into the pipe joint part 3 can be caused to smoothly flow from the joint side hole 77 into the base side hole 75A or 75B. This is possible for stabilizing supply of fuel gas to a premixing flow path 40.

Figure 40:
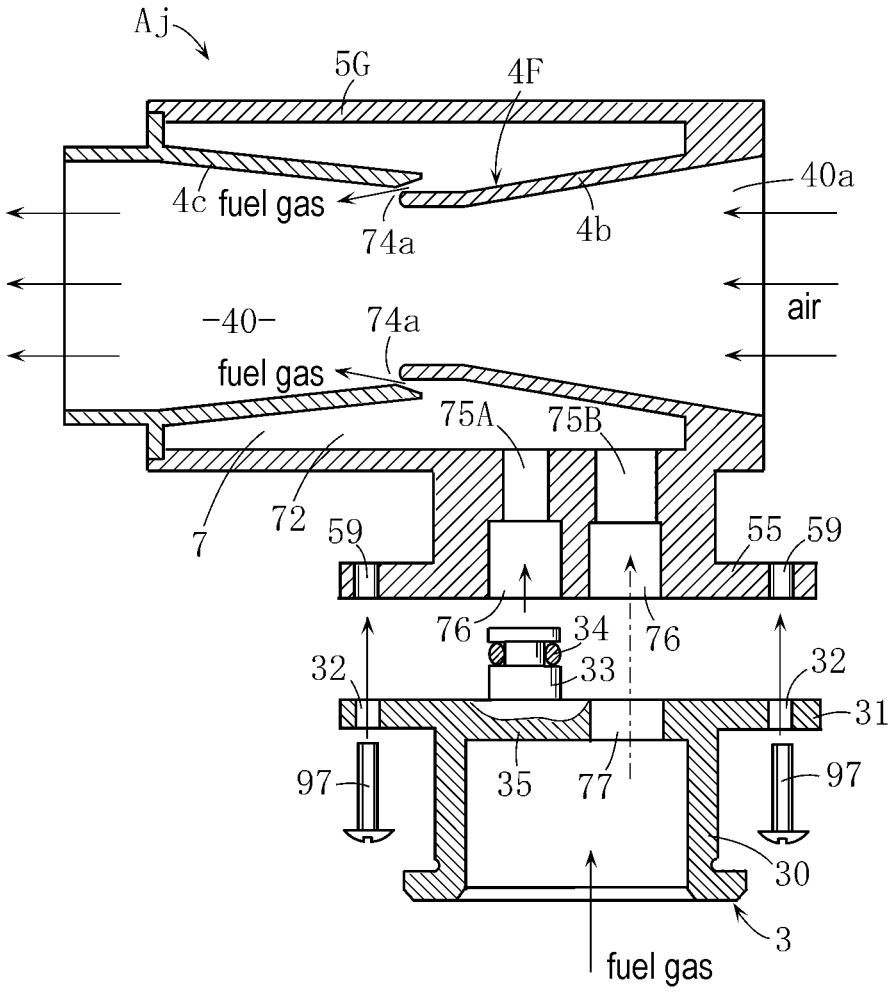
FIG. 40 is an exploded cross-sectional view illustrating another example of the premixing device according to the disclosure.

In a premixing device Aj illustrated in FIG. 40, a premixing flow path forming member 4F has the same configuration as the premixing flow path forming member 4F illustrated in FIG. 29. On the other hand, a base part 55 is provided to a housing member 5G. The base part 55 has the same configuration as the base part 55 illustrated in FIGS. 32B and 33 and has two base side holes 75A and 75B. A pipe joint part 3 can be attached to the base part 55.

In the present embodiment, it is possible to appropriately generate an air-fuel mixture of air and fuel gas in a premixing flow path 40 on the basis of the same principle as that of the embodiment illustrated in FIG. 29. Also, it is possible to appropriately obtain the operation intended by the disclosure by changing an attachment mode of the pipe joint part 3 with respect to the base part 55.

The disclosure is not limited to the contents of the above-described embodiments. Specific configurations of each part of the premixing device and the combustion apparatus according to the disclosure can be variously changed in design within the scope intended by the disclosure.

In the embodiments illustrated in FIGS. 1 to 29, the fuel gas flow path adjusting members 8 and 8A to 8E are indirectly attached to the premixing flow path forming members 4 and 4F via the housing members 5 and 5F, but the disclosure is not limited thereto. For example, when a pipe joint part for connecting a gas pipe is provided in the premixing flow path forming member, a configuration in which a fuel gas flow path adjusting member is attached to this portion (that is, a configuration in which the fuel gas flow path adjusting member is directly attached to the premixing flow path forming member) can be used.

In the embodiments illustrated in FIGS. 30A to 40, the base part 55 for attaching the pipe joint part is provided to the housing members 5 and 5G as a mounting member attached to the premixing flow path forming members 4 and 4F, but the disclosure is not limited thereto. For example, a configuration in which the base part is provided in the premixing flow path forming member, and the pipe joint part is directly attached to the premixing flow path forming member can also be used.

Specific shapes, sizes, materials, or the like of the fuel gas flow path adjusting member are not limited.

Fuel gas is not limited to natural gas and LP gas, and other types of fuel gas can also be an object to which the disclosure is applied. The combustion apparatus according to the disclosure is not limited to hot-water supply devices and, for example, may be combustion apparatuses for other applications such as for heating and incinerating. Also, the disclosure is not limited to types in which combustion gas is caused to advance downward, and types in which combustion gas is caused to advance, for example, upward can also be used.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A premixing device comprising:

a premixing flow path forming member which comprises a tubular part and a housing and causes air to flow in a predetermined direction and forms a premixing flow path for mixing fuel gas with the air; and a fuel gas flow path which comprises a fuel gas supply port which receives supply of the fuel gas from an outside and a fuel gas outlet which opens to the premixing flow path and guides the fuel gas supplied to the fuel gas supply port to the fuel gas outlet, wherein a member whose attachment mode is able to be changed is further provided, and flow path resistance of the fuel gas flow path is able to be changed when the attachment mode of the member is changed, wherein a fuel gas flow path adjusting member comprising a knob, a screw body insertion hole and a sealing protruding part and attached directly or indirectly to the premixing flow path forming member and configured to be able to close a part of the fuel gas flow path is provided as the member whose attachment mode is able to be changed, and wherein the attachment mode of the member refers to a configuration of attaching the member to the premixing flow path foiining member such that a part of the fuel gas flow path is closed, and a position and/or an area of the fuel gas flow path adjusting member closing the fuel gas flow path is changed and the flow path resistance of the fuel gas flow path is able to be changed when the attachment mode of the fuel gas flow path adjusting member is changed, wherein a portion of the fuel gas flow path close to the fuel gas supply port is divided into a plurality of parallel flow paths, and a plurality of fuel gas supply ports corresponding to the plurality of parallel flow paths is provided as the fuel gas supply port, and a position and/or the number in which the fuel gas flow path adjusting member closes the plurality of fuel gas supply ports is able to be changed, wherein first and second parallel flow paths having different flow path areas are provided as the plurality of parallel flow paths, and first and second fuel gas supply ports corresponding to the first and second parallel flow paths are provided as the plurality of fuel gas supply ports, and the fuel gas flow path adjusting member is able to selectively close one of the first and second fuel gas supply ports, wherein portions of the first and second parallel flow paths close to the first and second fuel gas supply ports have a same shape and size, and the fuel gas flow path adjusting member comprises a sealing protruding part which is able to be fitted into the portion close to the first and second fuel gas supply ports.

2. The premixing device according to claim 1, wherein the fuel gas includes predetermined first and second fuel gases of different types, and either one of a first attachment mode in which the fuel gas flow path is configured to correspond to the first fuel gas and a second attachment mode in which the fuel gas flow path is configured to correspond to the second fuel gas is able to be selectively set as the attachment mode of the fuel gas flow path adjusting member.

3. The premixing device according to claim 2, further comprising:

first and second gas type display portions indicating the first and second fuel gases, respectively, wherein the first gas type display portion is covered and hidden by the fuel gas flow path adjusting member and the second gas type display portion is in an exposed state when the fuel gas flow path adjusting member is set to the second attachment mode, while the second gas type display portion is covered and hidden by the fuel gas flow path adjusting member and the first gas type display portion is in an exposed state when the fuel gas flow path adjusting member is set to the first attachment mode.

4. The premixing device according to claim 1, further comprising:

a pipe joint part including a cylindrical part having an open distal end for connecting a gas pipe which supplies the fuel gas, wherein the fuel gas supply port is provided to an inner sidewall part in the cylindrical part, and the fuel gas flow path adjusting member is inserted into the cylindrical part from a distal end opening thereof and is attached to the inner sidewall part using a fastening member.

5. A premixing device comprising:

a premixing flow path forming member which comprises a tubular part and a housing and causes air to flow in a predetermined direction and forms a premixing flow path for mixing fuel gas with the air; and a fuel gas flow path which comprises a fuel gas supply port which receives supply of the fuel gas from an outside and a fuel gas outlet which opens to the premixing flow path and guides the fuel gas supplied to the fuel gas supply port to the fuel gas outlet, wherein a member whose attachment mode is able to be changed is further provided, and flow path resistance of the fuel gas flow path is able to be changed when the attachment mode of the member is changed, the premixing device further comprising:

a pipe joint part for connecting a gas pipe which supplies the fuel gas as the member whose attachment mode is able to be changed; and a base part to which the pipe joint part is attached, wherein a joint side hole and a base side hole which are configured to face each other to communicate with each other are provided in the pipe joint part and the base part as holes constituting a part of the fuel gas flow path, and the pipe joint part is configured to be able to change the attachment mode thereof with respect to the base part, wherein the attachment mode of the member refers to a configuration of attaching the member to the base part such that when the attachment mode is changed, a facing position and/or a facing area of the joint side hole and the base side hole is changed, and flow path resistance of the fuel gas flow path is able to be changed, wherein the fuel gas includes predetermined first and second fuel gases of different types, and either one of a first attachment mode in which the facing area is an area configured to correspond to the first fuel gas and a second attachment mode in which the facing area is an area configured to correspond to the second fuel gas is able to be selectively set as the attachment mode of the pipe joint part, wherein first and second gas type display portions respectively indicating the first and second fuel gases are provided on the base part, and the first gas type display portion is covered and hidden by the pipe joint part and the second gas type display portion is in an exposed state when the pipe joint part is set to the second attachment mode, while the second gas type display portion is covered and hidden by the pipe joint part and the first gas type display portion is in an exposed state when the pipe joint part is set to the first attachment mode.

6. The premixing device according to claim 5, wherein at least two base side holes having different inner diameters are provided to be aligned as the base side hole, the first attachment mode is a mode in which one of the two base side holes faces the joint side hole and the other is closed by the pipe joint part, and the second attachment mode is a mode in which a direction of the pipe joint part is reversed compared to that in the first attachment mode, and the one of the two base side holes is closed by the pipe joint part and the other faces the joint side hole.

7. A premixing device comprising:

a premixing flow path forming member which comprises a tubular part and a housing and causes air to flow in a predetermined direction and forms a premixing flow path for mixing fuel gas with the air; and a fuel gas flow path which comprises a fuel gas supply port which receives supply of the fuel gas from an outside and a fuel gas outlet which opens to the premixing flow path and guides the fuel gas supplied to the fuel gas supply port to the fuel gas outlet, wherein a member whose attachment mode is able to be changed is further provided, and flow path resistance of the fuel gas flow path is able to be changed when the attachment mode of the member is changed, the premixing device further comprising:

a pipe joint part for connecting a gas pipe which supplies the fuel gas as the member whose attachment mode is able to be changed; and a base part to which the pipe joint part is attached, wherein a joint side hole and a base side hole which are configured to face each other to communicate with each other are provided in the pipe joint part and the base part as holes constituting a part of the fuel gas flow path, and the pipe joint part is configured to be able to change the attachment mode thereof with respect to the base part, wherein the attachment mode of the member refers to a configuration of attaching the member to the base part such that when the attachment mode is changed, a facing position and/or a facing area of the joint side hole and the base side hole is changed, and flow path resistance of the fuel gas flow path is able to be changed, wherein the fuel gas includes predetermined first and second fuel gases of different types, and either one of a first attachment mode in which the facing area is an area configured to correspond to the first fuel gas and a second attachment mode in which the facing area is an area configured to correspond to the second fuel gas is able to be selectively set as the attachment mode of the pipe joint part, wherein at least two joint side holes having different inner diameters are provided to be aligned as the joint side hole, the first attachment mode is a mode in which one of the two joint side holes faces the base side hole and the other is closed by the base part, and the second attachment mode is a mode in which a direction of the pipe joint part is reversed compared to that in the first attachment mode, and the one of the two joint side holes is closed by the base part and the other faces the base side hole.

8. A combustion apparatus comprising the premixing device according to claim 1.

9. A combustion apparatus comprising the premixing device according to claim 5.

10. A combustion apparatus comprising the premixing device according to claim 7.

* * * * *